United States Patent [19]

Kageyama et al.

[11] Patent Number: 4,896,982

[45] Date of Patent: Jan. 30, 1990

[54] LEAD FEED MECHANISM FOR MECHANICAL PENCIL

[75] Inventors: Hidehei Kageyama; Yoshihide Mitsuya, both of Kawagoe, Japan

[73] Assignee: Kotobuki & Co. Ltd., Kyoto, Japan

[21] Appl. No.: 226,522

[22] Filed: Aug. 1, 1988

Related U.S. Application Data

[63] Continuation of Ser. No. 897,823, Aug. 19, 1986, abandoned.

[30] Foreign Application Priority Data

| | | | |
|---|---|---|---|
| Aug. 20, 1985 | [JP] | Japan | 60-182711 |
| Dec. 30, 1985 | [JP] | Japan | 60-298641 |
| Mar. 14, 1986 | [JP] | Japan | 61-57491 |

[51] Int. Cl.[4] ..... B43K 21/16

[52] U.S. Cl. ..... 401/65; 401/80

[58] Field of Search ..... 401/53, 65, 67, 74, 401/75, 80, 83, 84

[56] References Cited

U.S. PATENT DOCUMENTS

| | | | |
|---|---|---|---|
| 1,700,247 | 1/1929 | Woelm | 401/65 |
| 4,380,402 | 4/1983 | Andrews et al. | 401/74 |
| 4,452,544 | 6/1984 | Sumita | 401/65 X |
| 4,478,529 | 10/1984 | Morio | 401/65 X |
| 4,504,163 | 3/1985 | Hashimoto et al. | 401/53 |
| 4,521,126 | 6/1985 | Sakaoka et al. | 401/65 |
| 4,538,934 | 9/1985 | Brunner | 401/53 |
| 4,571,105 | 2/1986 | Sekiguchi | 401/65 |
| 4,620,811 | 11/1986 | Kageyama | 401/65 |

FOREIGN PATENT DOCUMENTS

| | | | |
|---|---|---|---|
| 0146128 | 3/1985 | European Pat. Off. | 401/65 |
| 2837586 | 7/1980 | Fed. Rep. of Germany | 401/65 |

*Primary Examiner*—Richard J. Apley
*Assistant Examiner*—David J. Bender
*Attorney, Agent, or Firm*—Sherman and Shalloway

[57] ABSTRACT

A lead feed mechanism for a mechanical pencil, in which a lead protruded by a certain length from a lead protection pipe housed in a bottom member attached at the bottom of the pencil is fed together with the pipe, and which comprises a lead chuck which is split in plural parts along the axis of the pencil and whose bottom sections pinch the lead on its outside circumferential surface. A sleeve contains the lead chuck so as to urge the lead chuck upwards by an elastic member. The sleeve includes an engaging portion provided on the inside circumferential surface of the top portion of the sleeve and engaged with an engaging portion provided on the outside circumferential surface of a bottom bearer for a lead pipe in which a spare lead is housed. A frame is provided around the sleeve which is fitted on the bottom with a pushing member which bears by the open top of the frame an elastic member provided between the bottom bearer and the frame. A slider is fitted in a cylindrical fixed member fixed in the bottom member so that the slider can be slid by the action of an elastic member. The top of the slider is separated at a prescribed distance from the pushing member.

8 Claims, 16 Drawing Sheets

LEAD FEED MECHANISM FOR MECHANICAL PENCIL

This application is a continuation, of application Ser. No. 897,823 filed Aug. 19, 1986, now abandoned.

BACKGROUND OF THE INVENTION

1. Field of the Invention

The present invention relates to a lead feed mechanism for a mechanical pencil, and particularly to a lead feed mechanism for a mechanical pencil wherein a top-pressing lead feed mechanism, a bottom-pressing lead feed mechanism and an automatic lead feed mechanism are provided so that a lead can be automatically fed by stopping pushing the lead onto the surface of writing paper.

2. Description of the Prior Art

Generally, the top of the body of a conventional mechanical pencil is pressed to protrude a lead by a desired length from a fixed lead pipe at the bottom of the mechanical pencil to perform writing. When the bottom of the lead is worn due to the writing, the writing is stopped and the top of the body of the pencil is pressed again to feed the lead to resume the writing. Such operation is repeated to enable the writing for a long period of time. However, the improvement of the lead feed mechanism of the mechanical pencil of the top-pressed type has been desired for the reasons why the fixed lead pipe scratches the surface of writing paper due to the wear of the lead and the finger-held position of the pencil needs to be changed in order to press the top of the pencil to feed the lead.

In order to perform the improvement of the lead feed mechanism of the mechanical pencil of the top-pressed type, various lead feed mechanisms of the bottom-pressing type, wherein the bottom of a mechanical pencil is once pushed onto writing paper or the like and the pushing of the bottom onto it is then stopped so that a lead is fed from the bottom of a movable lead pipe provided in a slider at the bottom of the pencil, have been proposed. A mechanical pencil, which was disclosed in the Japanese Patent Laid-open Gazette No. 57-188399, has one of the conventional lead feed mechanisms of the bottom-pressing type.

The conventional mechanical pencil of the bottom-pressed type has a construction as shown in FIG. 1. A bottom member 2 is screwed to the bottom of an outer pipe 1, which is held by the fingers of a writing person. The top of the outer pipe 1 is screwed to a nut 3*a* secured to the bottom of an upper pipe 3 containing a lead pipe 4. A cylindrical member 20 is fixed in the bottom member 2. A slider 21, to which a lead protection pipe 22 is secured at the bottom of the slider, is provided in the cylindrical member 20 so that the slider is slidable in the axial direction of the mechanical pencil. The slider 21 has a large-diameter portion and a small-diameter portion continuous to the step 21*a* of the large-diameter portion. A plurality of balls 23 are rotatably supported on the large-diameter portion. A friction member 24, which is made of rubber, synthetic resin or the like and has a nearly cylindrical form and whose inside circumferential surface is placed with a prescribed frictional force on the outside circumferential surface of a lead 5, is provided in the hole 21*b* of the slider 21, which is opened at the top of the slider. A first spring 25 is provided near the top of the cylindrical fixed member 20. The inside circumferential surface of the member 20 in the bottom member 2 has an inside circumferential groove 20*b*, which holds the balls 23 for the slider 21. A bottom bearer 6 is fitted in the bottom of the lead pipe 4. The outside circumferential surface of the bottom bearer 6 is fitted with a fixed pipe 7 projecting down from the bottom of the bearer 6. A slidable sleeve 10 is provided in the fixed pipe 7. A lead chuck 11, which is split in plural, for example, two parts to pinch the lead 5 on both sides, is provided in the sleeve 10. The thick bottom portion of the lead chuck 11 has recesses 11*a*. The bottom portion of the sleeve 10 has a tapered inside circumferential surface 10*a* whose diameter increases downwards. Balls 12 for causing the lead chuck 11 to pinch and release the lead 5 are provided between the tapered inside circumferential surface 10*a* and the recesses 11*a*. A circumferential projection 10*b* is provided at the bottom of the outside circumferential surface of the sleeve 10. A movable pipe 13 is provided over the circumferential projection 10*b*. A second spring 14 is provided between a flange 13*a* projecting from the top of the movable pipe 13 and a flange 6*a* provided on the outside circumferential surface of the central portion of the bottom bearer 6. A slider restriction pipe 15, to which an annular plate 15*a* is secured as a slider pusher at the bottom of the pipe 15, is slidably supported on the outside circumferential surface of the movable pipe 13. The top 15*b* of the slider restriction pipe 15 can be engaged with the flange 13*a* at the top of the movable pipe 13. A flange 15*c* provided in a prescribed position on the outside circumferential surface of the slider restriction pipe 15 near its bottom can be engaged with the bottom 1*a* of the outer pipe 1. A spring bearer 11*b* projects in an optional position from the outside surface of the top portion of the lead chuck 11. A step 10*c* is provided next to the smallest-diameter section of the tapered inside circumferential surface 10*a* of the sleeve 10. A third spring 16 is provided between the step 10*c* and the spring bearer 11*b*.

The operation of the conventional mechanical pencil of the bottom-pressed type, which has the construction described above is hereafter described. In the first step of the operation, the lead 5 protruding by a length of X down from the lead protection pipe 22 is pushed onto the surface P of writing paper, as shown in FIG. 1. Since the lead is supported by the friction member 24 fitted in the slider 21 and is pinched by the lead chuck 11 under a pinching force applied from the tapered inside circumferential surface 10*a* of the sleeve 10 through the balls 12, the slider, the lead chuck, the sleeve and the movable pipe 13 engaged with the circumferential projection 10*b* of the sleeve 10 follow together the lead 5 by the length of X.

In the second step of the operation, the writing person pushes the bottom of the mechanical pencil onto the surface P of the writing paper so that the lead 5 and the lead protection pipe 22 are moved down together in the outer pipe 1 and the bottom member 2. At the same time, the lead chuck 11 pinching the lead 5, and the sleeve 10, the movable pipe 13 and so forth following the lead chuck are moved up by a length of L1 against the elastic forces of the second and the third springs 14 and 16 so that the slider restriction pipe 15 following the movable pipe due to a sliding frictional resistance is moved following the movement of the lead chuck, the sleeve, the movable pipe and so forth. The balls 23 for the slider 21 are then engaged into the inside circumferential groove 20*b* of the cylindrical fixed member 20 as the distance of D1 between the top 21*a* of the slider 21 and the bottom of the annular plate 15*a* is kept constant, as shown in FIG. 2. As a result, the movement of the slider 21 is first stopped, and the flange 15*c* of the slider restriction pipe 15 following the lead chuck 11 is then engaged with the bottom 1*a* of the outer pipe 1 so that the movement of the slider restriction pipe is also stopped. Although the movement of the slider restriction pipe 15 is stopped, the movable pipe 13 and the sleeve 10 are moved by a length of L1-D1 as shown in FIG. 2, so that a gap of D2 corresponding to the length of L1-D1 is made between the flange 13*a* of the movable pipe 13 and the top 15*d* of the slider restriction pipe 15.

In the third step of the operation, when the writing person stops pushing the bottom of the mechanical pencil onto the surface P of the writing paper, the lead chuck 11 is moved down by the distance of D1 together with the sleeve 10, the movable pipe 13 and the slider restriction pipe 15 by the elastic force of the third spring 16 between the step 10*c* of the sleeve 10 and the spring bearer 11*b* of the lead chuck 11 as the lead chuck remains pinching the lead 5, so that the bottom of the annular plate 15*a* and the top 21*a* of the slider 21 come into contact with each other. As a result, the lead chuck 11 releases the lead 5 so that the lead is thrusted by a length corresponding to the gap D2, as shown in FIG. 3.

In the fourth step of the operation, the annular plate 15*a* urges the top 21*a* of the slider 21 downwards so that the balls 23 are moved out of the inside circumferential groove 20*b* of the cylindrical fixed member 20. As a result, the slider 21 is moved down by the length of L1 due to the elastic force of the first spring 25 so as to protrude the lead protection pipe 22 downwards by the length of L1 and to move down the lead 5 by the length of L1 until the bottom 10*c* of the sleeve 10 comes into contact with the inside circumferential flange of the slider restriction pipe 15. After all, the lead 5 is protruded from the bottom of the lead protection pipe 22, by a length corresponding to the gap of D2, so that a lead portion having a length of L2 and usable for writing is thrusted.

However, the above-described conventional mechanical pencil of the bottom-pressed type has various problems mentioned below.

Since an engagement mechanism comprising the balls 23 and the inside circumferential groove of the cylindrical fixed member 20 is used as a means for holding the slider 21 on the cylindrical fixed member 20 until the slider begins to be returned downwards after the slider provided in the bottom member 2 is moved up, a holding force necessary to perform the above-described ideal operation cannot be obtained, so that the lead 5 cannot be surely thrusted, and at the worst, the lead cannot be thrusted at all by pressing the bottom of the mechanical pencil. This is the first of the problems.

With the above-described operation, even if the pinching force is removed from the lead chuck by the sleeve 10 and the balls 12 in order to feed the lead 5, the lead chuck cannot surely stop pinching the lead, so that the lead cannot be thrusted downwards by the length corresponding to the gap of D2. This is the second of the problems.

Although the top of the lead chuck 11 is restrained by the inside circumferential surface of the sleeve 10 so as not to spread, a means for preventing the lead chuck from being compressed is not provided, so that the inside circumferential surface of the sleeve 10 sometimes causes the spring bearer 11*b* of the lead chuck 11 to play inwards due to a complicated action so as to spread the lead-pinching bottom portion of the lead chuck. For that reason, the pinching force of the lead chuck 11 on the lead 5 is reduced so as to hinder thrusting the lead. This is the third of the problems.

The gap between the open edge of the bottom 10*b* of the sleeve 10 and the lead chuck 11 is possibly increased by the balls 12 so that the balls drop out of the recesses 11*a* during the lead feeding operation. Once the balls 12 have dropped out, they cannot be fitted again in the complicated mechanical pencil. Therefore, the reliability of the mechanical pencil is low. This is the fourth of the problems.

Though the movable pipe 13 and the slider restriction pipe 15 are slid together in such a manner that they follow each other due to the sliding frictional resistance between the outside circumferential surface of the movable pipe and the inside circumferential surface of the slider restriction pipe, the sliding frictional resistance cannot be obtained to a prescribed degree when the outside and the inside circumferential surfaces of the movable pipe and the slider restriction pipe are worn due to the long-period use of the mechanical pencil, so that the lead cannot be thrusted by pressing the bottom of the pencil. This is the fifth of the problems.

Since the sleeve 10, the movable pipe 13 and the slider restriction pipe 15 are triply provided around the lead chuck 11 for pinching the lead 5 and housed in the outer pipe 1, the whole mechanism of the mechanical pencil is complicated, and it is difficult to make the pencil thin, so that it is hard to meet the requirement of reducing the size and weight of the pencil. This is the sixth of the problems.

SUMMARY OF THE INVENTION

The present invention is to solve all of the above-mentioned problems. Accordingly, the present invention was made to attain various objects mentioned below.

It is the first object of the present invention to provide a mechanical pencil wherein a slider and a fixed member inside a bottom member are engaged with each other not by a low-reliability large mechanism such as a combination of balls and an inside circumferential groove but by mutually-facing engaged projections provided in prescribed positions on the outside and the inside circumferential surfaces of the slider and the fixed member, so as to surely protrude a lead by a prescribed length from the bottom of a lead protection pipe.

It is the second object of the present invention to provide a mechanical pencil wherein the pinching of a lead by a lead chuck can be instantaneously and surely stopped to prevent the sliding or the like of the lead chuck in the lead feeding operation of the mechanical pencil so as to thrust the lead by an exact length.

It is the third object of the present invention to provide a mechanical pencil wherein the meeting surfaces of a lead chuck are provided in almost the axially central portion of the chuck and the top portion of the chuck is urged to be normally in a spread state, so as to maximize the pinching force of the lead pinching portion of the lead chuck to surely pinch a lead.

It is the fourth object of the present invention to provide a mechanical pencil wherein the gap between the bottom of a sleeve and an interference member at the bottom of a slider restriction pipe is made smaller than the diameter of each of balls for the pinching action of a lead chuck so as to prevent the balls from dropping out of recesses, the reduce the trouble of the mechanical pencil and enhance its reliability.

It is the fifth object of the present invention to provide a mechanical pencil wherein a mutual follow mechanism for overlaid sliding pipes housed in an outer pipe is constituted not by a low-reliability sliding frictional resistance means but by a sure engagement means so as to make the mechanical pencil durable in long-period use.

It is the sixth object of the present invention to provide a mechanical pencil wherein the number of the parts of various overlaid pipes housed in the narrow gap between the outside circumferential surface of a lead chuck and the inside circumferential surface of an outer pipe is reduced to simplify a lead feed mechanism of the sliding type and make the mechanism placeable in the outer pipe of small diameter so as to reduce the size and weight of the mechanical pencil.

BRIEF DESCRIPTION OF THE DRAWINGS

FIG. 37(*b*) shows a longitudinally sectional view of the cylindrical member of the sixth embodiment;

FIG. 38(*b*) shows a longitudinally sectional view of the movable pipe of the sixth embodiment.

DETAILED DESCRIPTION OF THE PREFERRED EMBODIMENTS

Embodiments of the present invention are hereafter described with reference to the drawings.

Figure 5:
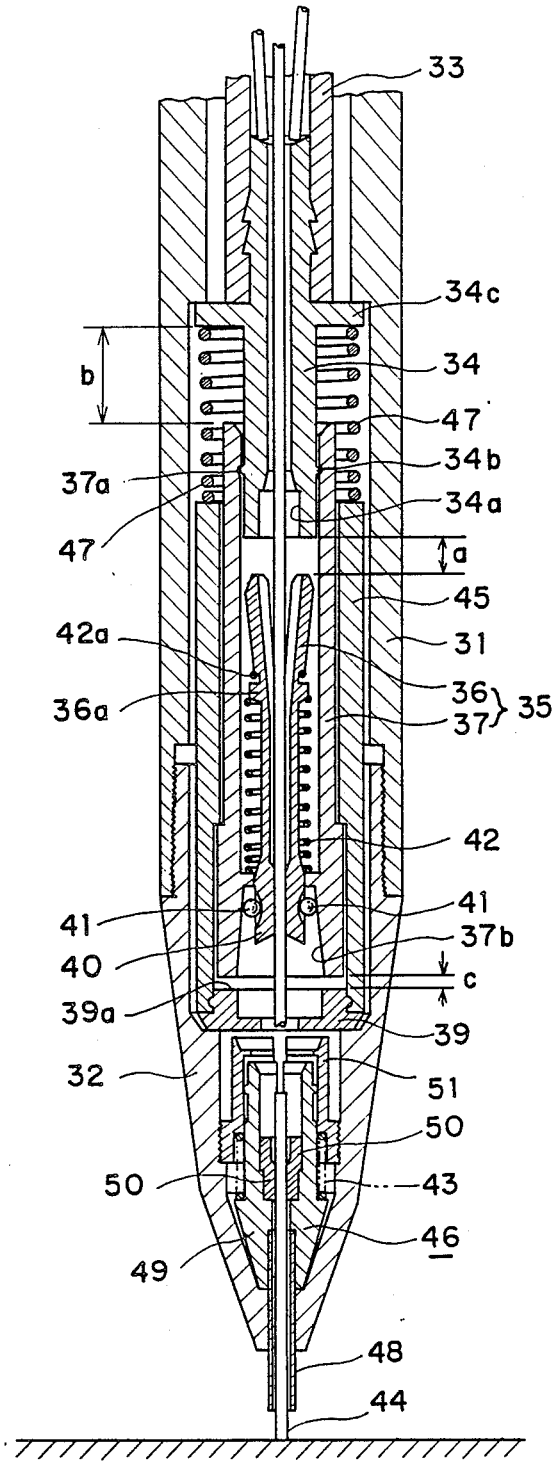
FIG. 5 shows a longitudinally sectional view of a lead feeding mechanism for a mechanical pencil, which is a first embodiment of the present invention.
Figure 6:
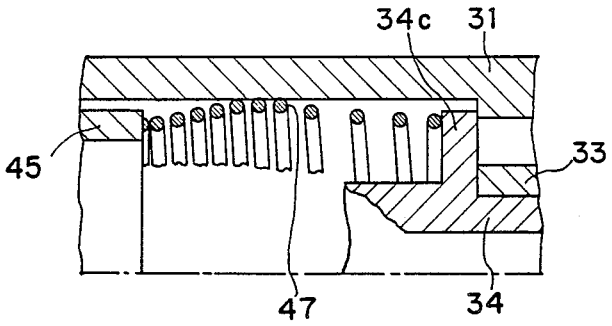
FIG. 6 shows an enlarged longitudinally-sectional view of the second spring of the first embodiment.

FIG. 5 shows a first embodiment of the present invention in which a bottom member 32 is provided at the bottom of an outer pipe 31, and a lead pipe 33 is provided in the outer pipe 32 so that the lead pipe can be slid downwards in the axial direction thereof. A bottom bearer 34 is fitted on the bottom of the lead pipe 33. A lead feed mechanism 35 is provided so that a distance of a is defined to the bottom of the bottom bearer 34.

The bottom bearer 34 has a bottom hole 34*a*, in which the top of a lead chuck 36 described hereinafter is engaged by pushing, and a projection 34*b*, which is movably engaged in the recess 37*a* of a sleeve 37 described hereinafter. A distance of b is defined between the top of the sleeve 37 and the flange 34*c* of the bottom bearer 34.

The lead feed mechanism 35 comprises balls 41 held on a ball holding portion 40 near the bottom of the lead chuck 36 split in two parts, the sleeve 37 fitted with the lead chuck 36 inside the sleeve and engaged at the top portion of the sleeve with the bottom bearer 34, and a first elastic member 42 urgingly disposed between the sleeve 37 and the engaging step 36*a* of the lead chuck 36 so as to clamp the lead chuck.

The balls 41 held on the bottom portion of the lead chuck 36 are in rolling contact with the tapered inside surface 37*b* of the bottom portion of the sleeve 37. The first elastic member 42 has a weaker urging force than a second elastic member 43 described hereinafter, and acts to clamp the engaging step 36*a* of the lead chuck 36 by the small-diameter top 42 of the first elastic member 42. For that reason, the first elastic member 42 acts not only to clamp the lead chuck 36 in a conventional manner but also to assemble the two split parts of the lead chuck with each other.

Although the lead chuck 36 is split in two parts in the first embodiment shown in FIG. 5, the lead chuck may be split in three or more parts or may be an unsplit single body. It is preferable to provide the mutual contact sections of the lead chuck 36 with engaging projections and recesses, anti-slipping jags or the like in order to prevent the axial discrepancy or the like of the split parts of the lead chuck.

The ball holding portion 40 of the lead chuck may be made of holes for holding the balls 41, or may be made of a housing means for holding the balls 41 not to drop off. The balls 41 are rotatable on the ball holding portion 40.

The lead feed mechanism 35 is almost all housed in a frame 45, which is disposed in the outer pipe 31 so that the frame can be slid in the axial direction thereof. The bottom of the frame 45 is fitted with a bottom pipe 39, which acts to push a slider 46 and to restrict the downward movement of the sleeve 37. A third elastic member 47 is urgingly disposed between the top of the frame 45 and the bottom bearer 34. The inside surface of the frame 45 is provided with an inside step 45*a* engaged with the outside step 37*c* of the sleeve 37. As a result, the sleeve 37 is pushed downwards by the frame 45 urged downwards by the third elastic member 47 which resists the pressure of writing.

A distance of c is defined between the top 39*a* of the bottom pipe 39 and the bottom of the sleeve 37. The distance of c corresponds to the fed quantity of the lead fed by top pressing, as described hereinafter.

The third elastic member 47 has three functions as follows:

① A function of preventing the lead pipe 33 from playing

② Although the urging force of the third elastic member 47 is stronger than normal writing pressure, the member 47 has a buffer function of retracting the frame 45 if excessive writing pressure should act to the lead 44 in writing.

③ If an eraser (not shown in the drawings) is provided at the top of the lead pipe 33, the third elastic member 47 has a function of supporting the eraser when it is in use.

A compressive force is applied to the third elastic member 47 by the frame 45 moved up by bottom pressing in lead feeding operation described hereinafter. It is preferable that the eraser supporting function, in which the lead pipe 33 is urged upwards, is performed by a prescribed strong urging force, and the frame 45 is urged downwards by a prescribed weak urging force in order to lightly and smoothly perform the bottom pressing. For that purpose, the numbers of the lower and upper windings of the third elastic member 47 are made different from each other, the nearly central portion of the member 47 is placed in contact with the inside surface of the outer pipe 31, the downward urging force of the member 47 is made weak, and the upward urging force of the member 47 is made strong.

The slider 46 is provided in the bottom member 32 so that the slider can be slid in the axial direction thereof. The slider 46 comprises a slider body 49, in which a slider pipe 48 is fitted as a lead protection pipe in the center of the slider body, and a friction member 50 fitted in the slider body 49 to apply prescribed frictional pressure to the lead 44. The slider is urged downwards by the second elastic member 43 engaged on a bearer 51 secured at the top thereof to the bottom member 32. The friction member 50 exerts a prescribed frictional force on the lead 44. The prescribed frictional force is stronger than the urging force of the first elastic member 42 and nearly equal to or slightly stronger than that of the second elastic member 43 in automatic lead feeding operation described hereinafter. In the automatic lead feeding operation, the first elastic member 42 of weaker urging force is compressed by the frictional force exerted by the friction member 50 of the slider 46 moved down by the second elastic member 43, so as to feed the lead 44 downwards. The slider 46 can be moved up through a distance of d, at the end of which a step 49*a* comes into contact with the bottom of the bearer 51.

Figure 7:
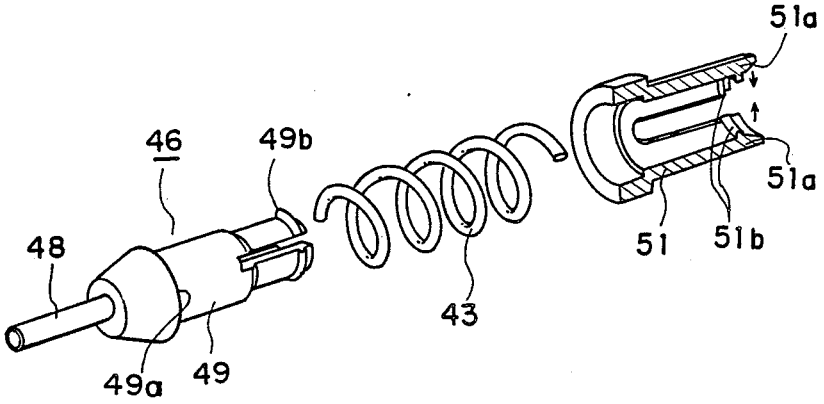
FIG. 7 shows an enlarged and exploded perspective view of the slider, first spring and cylindrical fixed member of the first embodiment.

In the first embodiment, two legs 51*a* openable and closable in the radial direction of the bearer 51 as shown by arrows in FIG. 7 are provided at the top of the bearer. The number of the legs 51*a* is not limited to two. Inside projections 51*b*, which are engaged with the projections 49*b* of the slider body 49, are provided on the inside circumferential surfaces of the legs 51*a* so that the slider 46 can be stopped for a prescribed time by the engagement of the projections 51*b* and the projections 49*b*. Slender legs openable and closable in the radial direction of the slider body 49 may be provided thereon and may include projections engaged with the inside projections of the bearer, so that the slender legs serve as means for stopping the slider 46 for the prescribed time.

Figure 8:
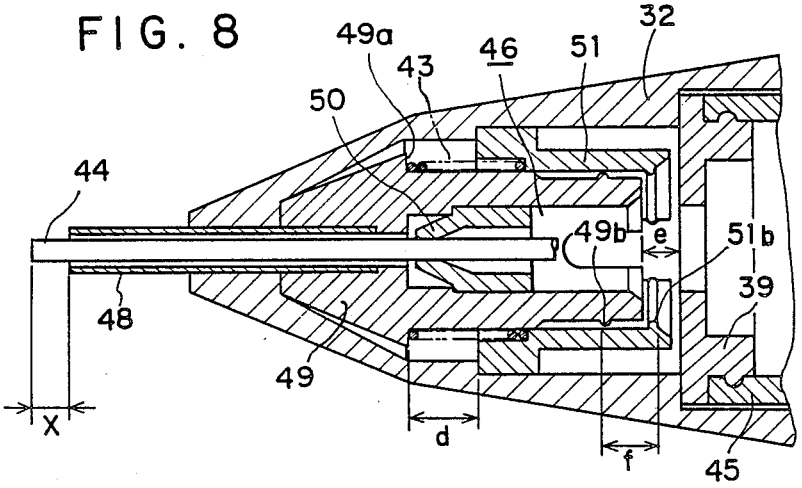
FIGS. 8–13 show partial longitudinally-sectional views for describing the operation of the first embodiment.

FIG. 8 shows a distance of e defined between the top of the slider 46 and a bottom pipe 9 when the slider 46 is not retracted. The distance of e corresponds to the fed quantity of the lead fed by the bottom pressing. The distance of e and the distance of f between the top of the inside projection 51*b* and the bottom of the projection 49*b* (the projections 51*b* and 49*b* are engaged with each other through the distance of f) have a relation to each other as $f > e$.

The above-mentioned distances of a and b have a relation to each other as $a < b$.

Since the lead 44 is likely to have an irregularity in size, it is preferable to design that ① the distances of a and d are nearly equal to each other and ② the distance of d is slightly larger than the distance of a, with a moderate difference, when the lead 44 is pinched by the lead chuck 36. As a result of the design, the protruded quantity of the lead 44 is made constant or almost constant when the second time of the bottom pressing is performed. However, even if the distance of a is slightly larger than the distance of d, with a moderate difference, differently from the cases ① and ②, a generally-allowable protruded quantity of the lead 44 is assured so that no problem arises.

The lead feeding operation according to the present invention is hereafter described. There are three kinds of the lead feeding operation.

Figure 1:
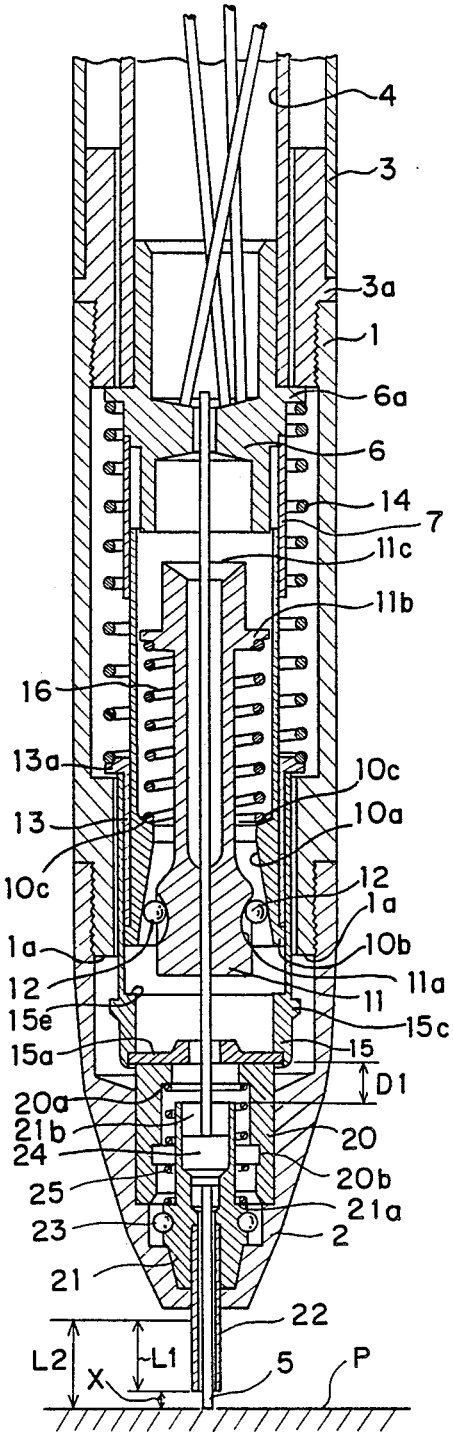
FIG. 1 (PRIOR ART)
FIG. 1 shows an enlarged longitudinally-sectional view of an example of a conventional mechanical pencil of the bottom-pressed type.
Figure 2:
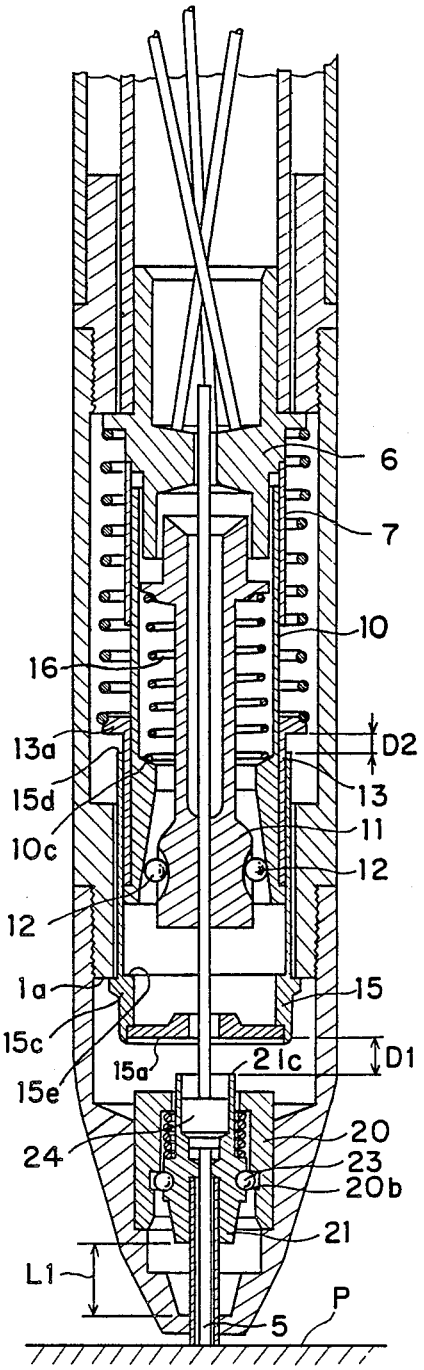
FIG. 2 (PRIOR ART)
FIG. 2 shows an enlarged longitudinally-sectional view for describing the lead feeding operation of the mechanical pencil shown in FIG. 1.
Figure 3:
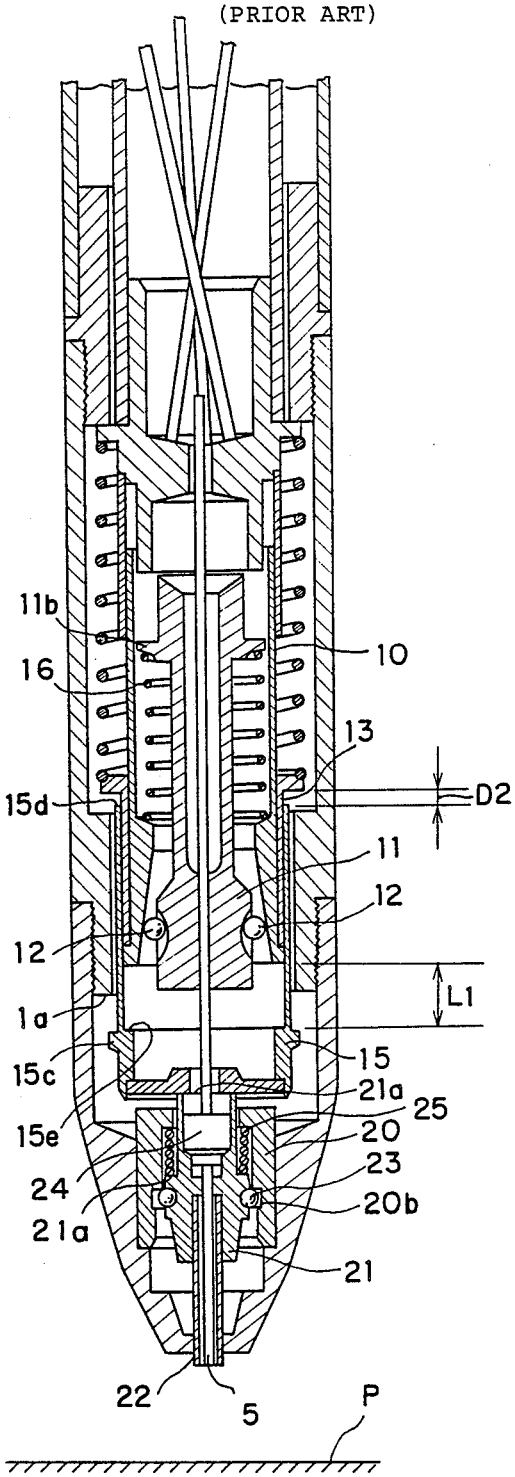
FIG. 3 (PRIOR ART)
FIG. 3 shows an enlarged longitudinally-sectional view indicating the step of the lead feeding operation of the mechanical pencil, which follows that of the operation indicated in FIG. 2.
Figure 4:
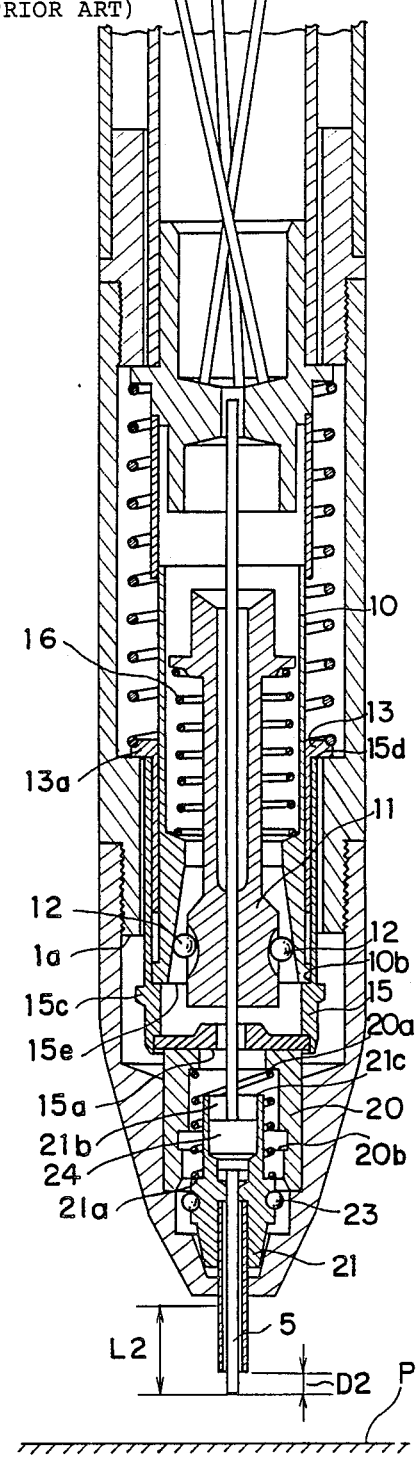
FIG. 4 (PRIOR ART)
FIG. 4 shows an enlarged longitudinally-sectional view indicating the step of the lead feeding operation of the mechanical pencil, which follows that of the operation indicated in FIG. 3.

The first kind of the lead feeding operation is conventional lead feeding operation, which is performed by pressing the top of the lead pipe 33. The sleeve 37 engaged with the bottom bearer 34 through the action of a recess 37*a* and a projection 34*b* as shown in FIG. 5 or through the action of a notched ring 8 as shown in FIG. 2 is moved down together with the lead pipe 33 and so forth by pressing the top of the lead pipe, and is stopped by coming into contact with the bottom of the bottom pipe 39. However, the bottom bearer 34 integrally coupled with the lead pipe 33 is pushed down further while slipping on the inside surface of the sleeve 37, so as to push down the top of the lead chuck 36 to conventionally feed the lead.

Figure 9:
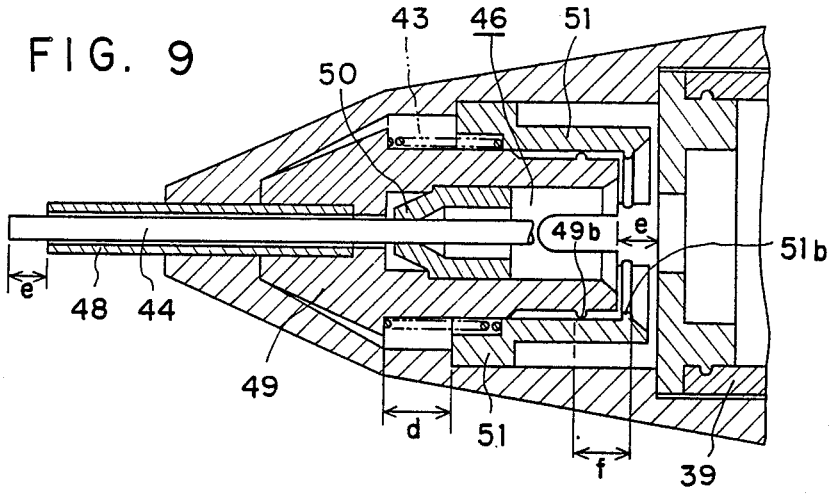
Figure 10:
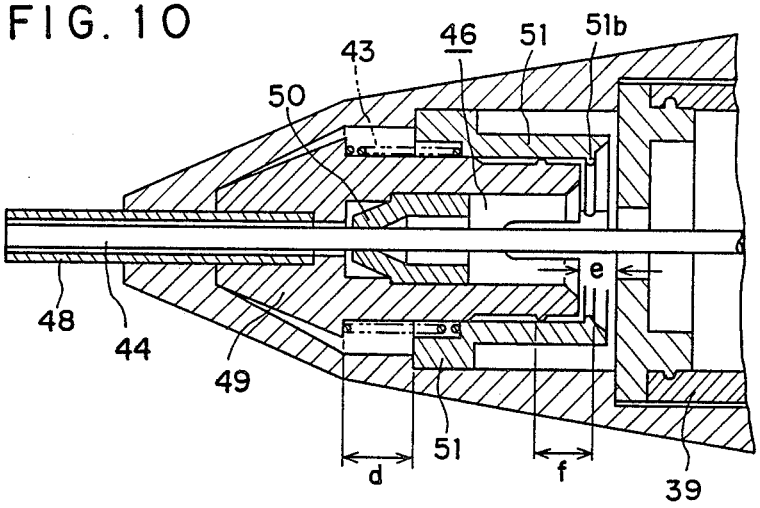

The second kind of the lead feeding operation is automatic lead feeding operation, which is automatically performed by stopping the writing. The writing is normally performed as the lead 44 remains protruded by a prescribed quantity of X from the slider pipe 48, as shown in FIG. 9. As the writing is continued, the lead 44 is gradually worn so that the bottom of the lead becomes flush with the bottom of the slider pipe 48, as shown in FIG. 10. Even in that state, the slider 46 can be moved up against the urging force of the second elastic member 43, through the distance of e shown in FIGS. 5, 8 and 9, to the miximum.

Figure 11:
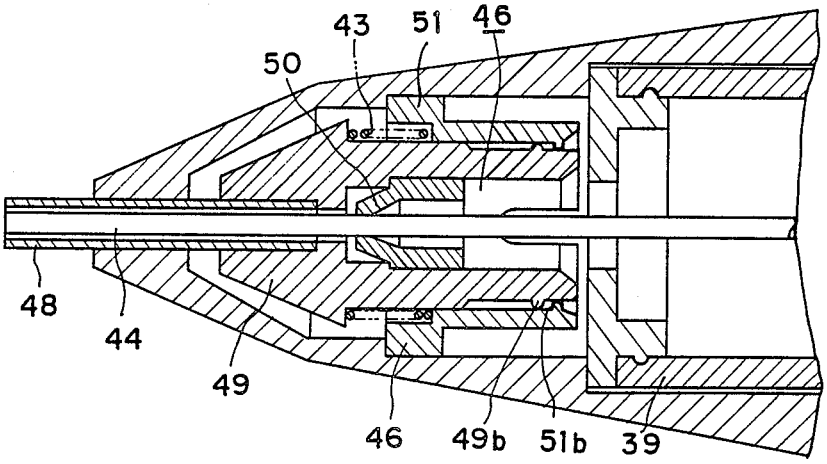

It takes a long time of the writing to wear the lead 44 to move up the slider 46 through the distance of e. The lead 44 is worn by only about 0.01 mm when an ordinary adult writes five alphabetical characters on good-quality paper with a mechanical pencil having a lead of HB in hardness and 0.5 mm in diameter. Therefore, it is usually impossible that the writing is incessantly continued until the slider 46 is moved up through the distance of e. The writing should be thought to be stopped before the slider 46 is moved up through the distance of e. Then, let's suppose that the writing is stopped in a state shown in FIG. 11 and the bottom of the slider pipe 48 is separated from the surface of writing paper. As a result, the slider 46 is moved down by the urging force of the second elastic member 43, and the lead 44 is pulled downwards together with the slider 46 by the frictional force exerted by the friction member 50. Since the clamping force on the lead chuck 36 pinching the lead 44 is applied to the lead chuck, as shown in FIG. 5, by the first elastic member 42 of weaker urging force than the second elastic member 43, the lead chuck is compressed by the downward pulling force on the lead 44 so that the lead chuck is allowed to be moved down as a whole. When the lead chuck 36 is moved down, the balls 41 on the bottom portion of the lead chuck roll on the tapered inside surface 37*b* of the sleeve 37 so that as the lead chuck is moved down, the lead pinching force of the lead chuck decreases to allow the lead 44 to be fed. As a result of such a series of operation steps, a state shown in FIG. 10 is established again. The lead 44 is thus automatically sent out so that the writing can be continually performed until the slider 46 is moved up through the distance of e to the maximum.

Figure 12:
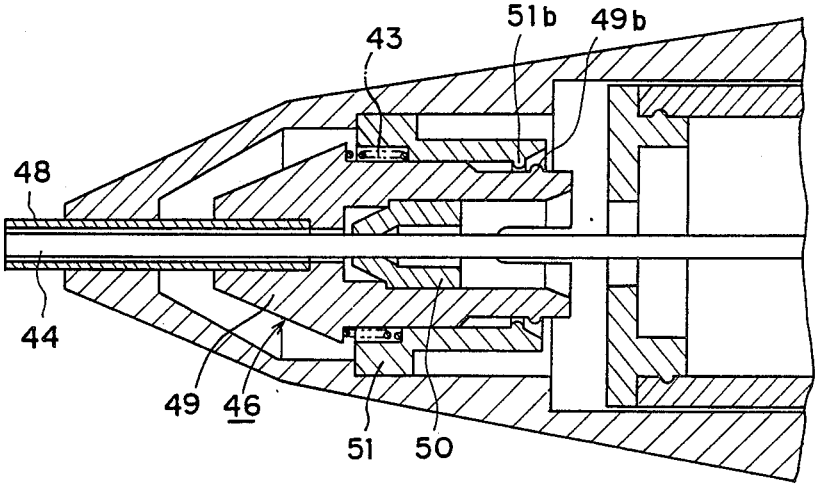
Figure 13:
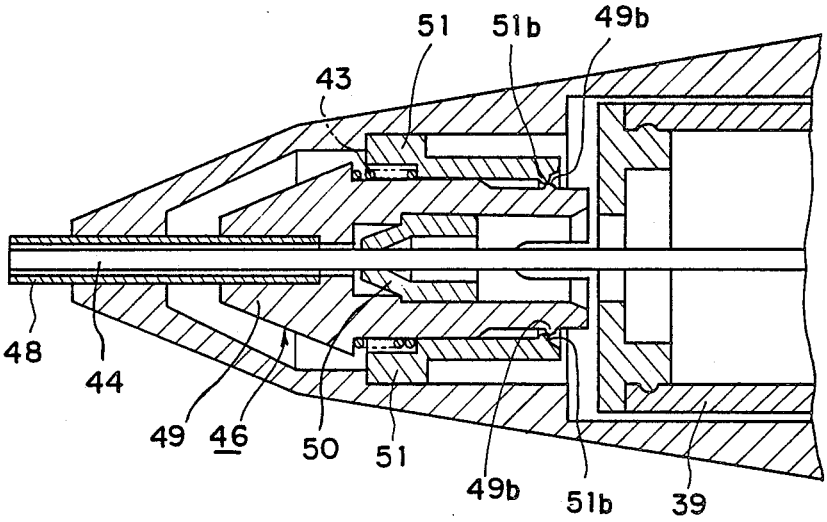

The third kind of the lead feeding operation is performed by pressing the bottom of the slider 46 onto the surface of the writing paper. The bottom of the slider 46 is pressed onto the surface of the writing paper in two cases as follows:

(i) The bottom of the slider 46 is pressed onto the surface of the writing paper as the lead 44 remains unprotruded from the bottom of the slider pipe 48, as shown in FIG. 10. As a result, the lead 44 is always protruded from the slider pipe 48, by a length equal to the distance of e, as shown in FIGS. 8 and 9 (X=e). Since the bottom of the slider 46 is pressed, the lead chuck 36 is moved up pinching the lead 44, and the slider 46 is also moved up. The moved-up quantities of the lead chuck 36 and the slider 46 are equal to each other. To the maximum, the lead chuck 36 and the slider 46 can be moved up through the distance of d shown in FIGS. 8, 9 and 10. Since the distances of a and d shown in FIG. 5 have the above-mentioned relation to each other, the lead 44 remains held in a pinched state throughout the upward movement of the lead chuck 36 except when the top of the lead chuck comes into contact with the bottom bearer 34 (when the distance of a is smaller than the distance of d). The frame 45 and the bottom pipe 39 are moved up against the urging force of the third elastic member 47 through the action of the inside step 45*a* and the outside step 37*c* along with the upward movement of the lead chuck 36. Since the distances of d, e and f have relations to each other as d>e and d>f, the projection 49*b* of the slider body 49 first goes over the inside projection 51*b* of the bearer 51 and the top of the slider body 49 thereafter protrudes from that of the bearer 51, as shown in FIG. 12, as the slider 46 is moved up through the distance of d to the maximum. In states shown in FIGS. 5 and 12, the distance of e is maintained between the top of the slider body 49 and the bottom pipe 39. When the slider 46 pressed onto the surface of the writing paper is separated therefrom, the lead feed mechanism 35 including the sleeve 37 and the lead chuck 36 and the frame 45 are moved up chiefly by the urging force of the third elastic member 47 until the bottom pipe 39 comes into contact with the step 32*a* of the bottom member 32. At that time, the lead chuck 36 keeps pinching the lead 44. Although the slider 46 is moved down by the urging force of the second elastic member 43, the slider is temporarily stopped by the projections 49*b* of the slider body 49 engaged with the inside projections 51*b* as shown in FIG. 12. Since the lead feed mechanism 35 is moved down in a state of pinching the lead 44, even during the temporary stopped of the slider 46, the lead 44 is moved down relative to the slider 46 until the bottom pipe 39 comes into contact with the top of the slider body 49 to perform disengagement to cease the temporary stoppage. The moved-down quantity of the lead 44 is equal to the distance of e. As a result of the bottom pressing in the case (i), a state in which the lead 44 is protruded by a length of e from the bottom of the slider pipe 48 as shown in FIGS. 8 and 9 (X=e) is established.

(ii) The bottom of the slider 46 is pressed onto the surface of the writing paper as the lead 44 remains protruded from the bottom of the slider pipe 48 as shown in FIG. 8. At that time, regardless of the already protruded quantity of the lead 44, the state in which the lead is protruded by the length of e from the slider pipe 48 as shown in FIGS. 8 and 9 (X=e) is established. Let's suppose that the already protruded quantity of the lead 44 is X as shown in FIG. 9. When the bottom of the slider 46 is pressed, only the lead feed mechanism 35 and the frame 45 are first moved up together with the lead 44 through a distance of X. After that, the slider 46 is moved up together with the lead feed mechanism 35 and the frame 45 in the same manner as the case (i). As a result, the moved-up quantity of the lead chuck 36 is made by X larger than that of the slider 46. One of the above-mentioned cases ①, ② and ③ of the relation between the distances of a and d exists in the upward movement of the lead chuck 36. In the case ① in the distances of a and d are almost equal to each other, the top of the lead chuck 36 comes into contact with the bottom hole 34*a* of the bottom bearer 34 due to the increase in the moved-up quantity of the lead chuck 36. Because of the contact, a force acts to the top of the lead chuck 36 to spread the top outwards to allow the lead 44 to slip on the lead chuck. Since the lead 44 thus slips, the protruded quantity "X" of the lead is absorbed by the lead chuck 36. As a result, it becomes no problem how much the protruded quantity "X" of the lead 44 before its being pushed onto the surface of the writing paper is. For that reason, the lead 44 and the slider 46 are thought to be flush with each other as shown in FIG. 10. The slider 46, the lead feed mechanism 35 and so forth are thereafter operated in all the same manner as the case (i), so that the lead is protruded by a quantity of e from the slider 46 as shown in FIGS. 8 and 9 (X=e). In the case ② in which the distance of d is larger than the distance of a, with the moderate difference, what differs from the case ① is that the top of the lead chuck 36 and the bottom bearer 34 come into contact with each other earlier in the upward movement of the lead 44 than in the case ①. If the distance of d is larger than the distance of f, the slider 46 is temporarily stopped by the engagement of the projections 49*b* and the inside projections 51*b* so that the lead feed mechanism 35 moves the lead 44 by a length of e relative to the slider 46 temporarily stopped. For that reason, the protruded quantity of the lead 44 always becomes e. In the case ③ in which the distance of a is larger than the distance of d, with the moderate difference, the time when the lead chuck 36 and the bottom bearer 34 come into contact with each other is made later than in the case ①, so that the protruded quantity "X" of the lead is not all eliminated by the slip of the lead, and a very small protruded quantity "$\alpha$" of the lead remains. For that reason, the protruded quantity of the lead becomes $e+\alpha$ after the bottom of the slider 46 is pressed. However, since the quantity of "$\alpha$" is very small, it is hardly a problem in writing.

Figure 14:
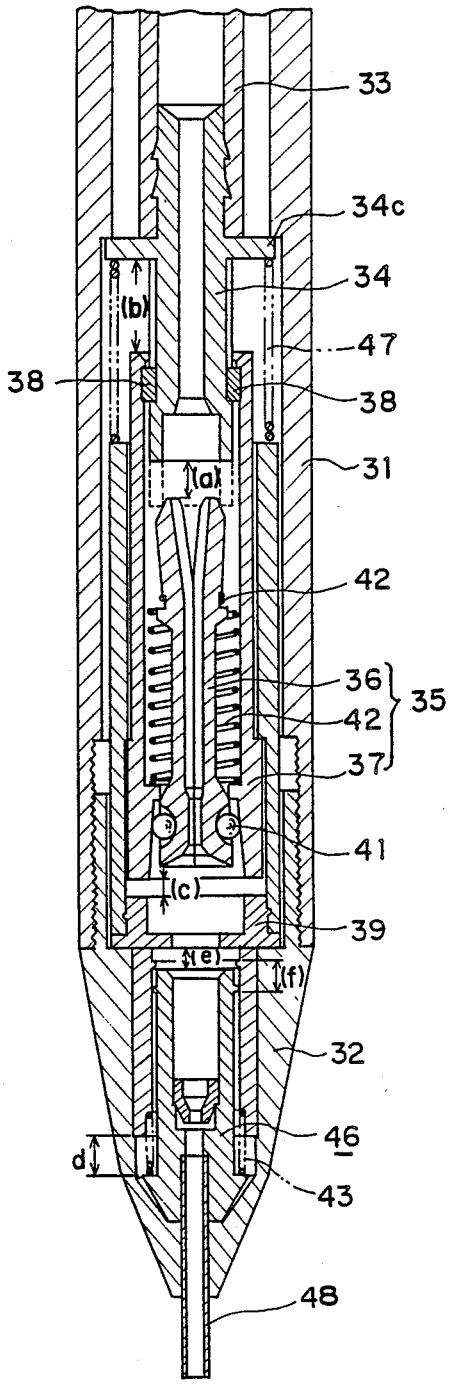
FIG. 14 shows a longitudinally sectional view of a lead feeding mechanism for a mechanical pencil, which is a second embodiment of the present invention.
Figure 15:
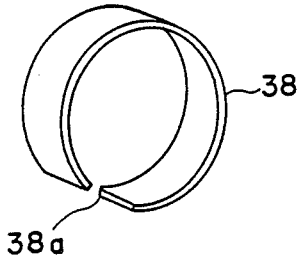
FIG. 15 shows a perspective view of an engagement mechanism for the lead pipe bottom bearer and sleeve of the second embodiment.

Although the engagement of the bottom bearer 34 and the sleeve 37 is temporarily maintained by that of the circumferential projection 34*b* and the circumferential recess 37*a* in the first embodiment described above, the same effect is produced in a second embodiment of the present invention, in which a bottom bearer 34 and a sleeve 37 are slid and restricted by an annular engaging member 38 having a slit 38*a*, as shown in FIGS. 14 and 15.

Figure 16:
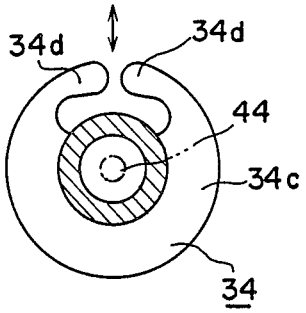
FIG. 16 shows a cross-sectional view of an engagement mechanism for the lead pipe bottom bearer and sleeve of a lead feed mechanism for a mechanical pencil, which is a third embodiment of the present invention.

In a third embodiment of the present invention, which is shown in FIG. 16, the flange 34*c* of a bottom bearer 34 for a lead pipe 33 is notched to provide spreadable portions 34*d* to apply a prescribed reactionary force against the upward movement of the bottom bearer 34 by the friction between the inside surface of an outer pipe 31 and the portions 34*d*.

Figure 17:
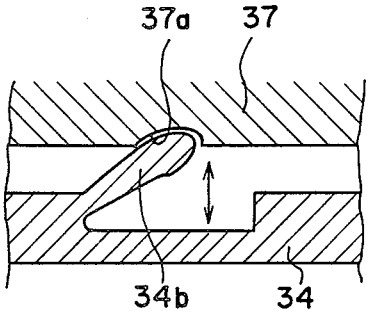
FIG. 17 shows a partial enlarged longitudinally-sectional view of an engagement mechanism for the lead pipe bottom bearer and sleeve of a lead feed mechanism for a mechanical pencil, which is a fourth embodiment of the present invention.

In a fourth embodiment of the present invention, which is shown in FIG. 17, a bottom bearer 34 is provided with a foot-shaped projection 34*b* movably engaged in the recess 37*a* of a sleeve 37.

Figure 18:
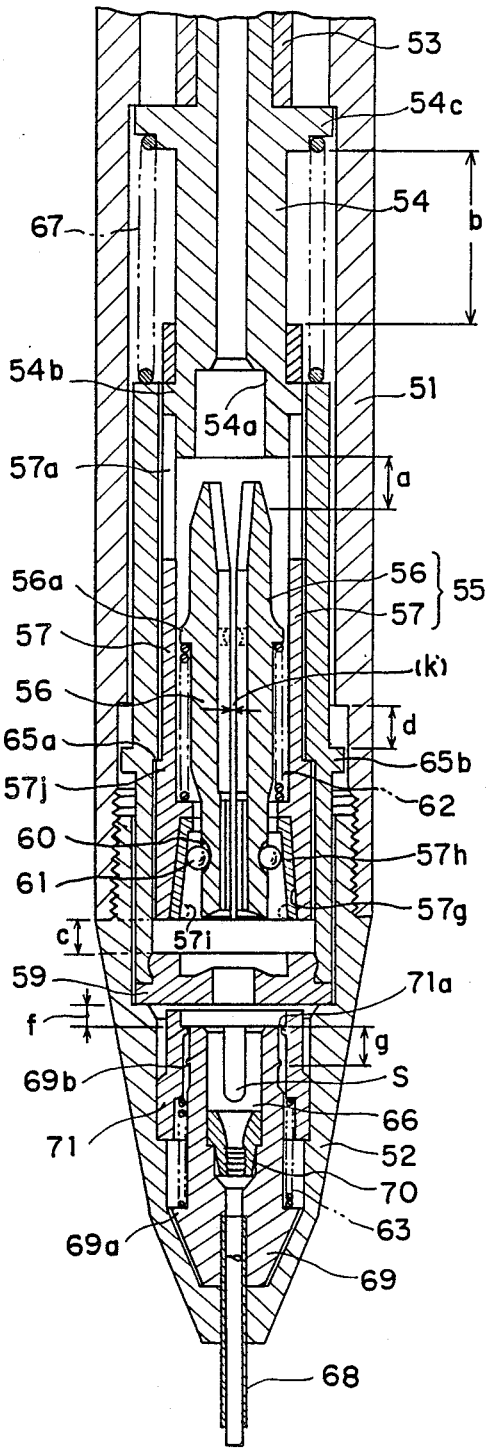
FIG. 18 shows a longitudinally sectional view of a lead feed mechanism for a mechanical pencil, which is a fifth embodiment of the present invention.

A fifth embodiment of the present invention is hereafter described with reference to the drawings. As shown in FIG. 18, a bottom member 52 is provided at the bottom of an outer pipe 51, and a lead pipe 53 is disposed in the outer pipe 51 so that the lead pipe can be slid down in the axial direction thereof. The bottom of the lead pipe 53 is fitted with a bottom bearer 54. A lead feed mechanism 55 is provided so that a contact distance of a is defined to the bottom of the bottom bearer 54. The bottom bearer 54 has a bottom hole 54*a*, in which the top of a lead chuck 56 described hereinafter is engaged by pushing. The bottom bearer 54 is movably engaged with a sleeve 57. Any construction for engaging the bottom bearer 54 and the sleeve 57 with each other can be used in this embodiment as far as the bearer 54 and the sleeve 57 are moved together until the sleeve comes into contact with a bottom pipe 59, and only the bearer is moved down after the sleeve comes into contact with the bottom pipe. An example of the construction is shown in FIG. 19.

Figure 19:
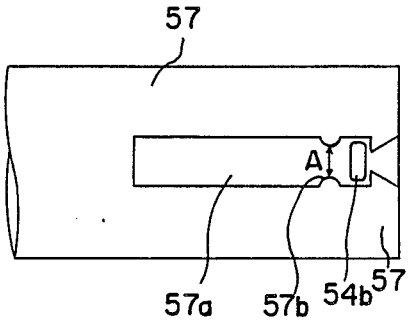
FIGS. 19–25 show main part explanation views of various modifications of an engagement construction for the lead pipe bottom bearer and sleeve of the fifth embodiment.

FIG. 19 shows a modification of the sleeve 57. In the modification, a groove 57*a*, in which the projection 54*b* of the bottom bearer 54 is movably engaged, is provided. Projections 57*b* are provided in the groove 57*a*. The distance of A between the projections 57*b* is smaller than the width of the projection 54*b* so that the projection 54*b* is engaged with the projections 57*b* in the groove 57*a*, and the bottom bearer 54 and the sleeve 57 are moved together until the sleeve comes into contact with the bottom pipe 59. After the sleeve 57 comes into contact with the bottom pipe 59, the projection 54*b* pushes open the projections 57*b* so that only the bottom bearer 54 is moved down to the bottom of the groove 57*a*.

Figure 20:
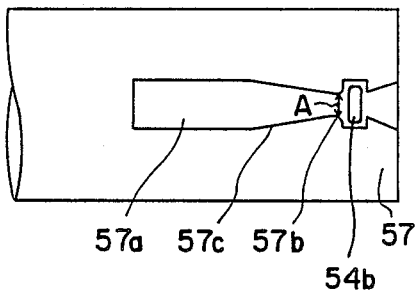
Figure 21:
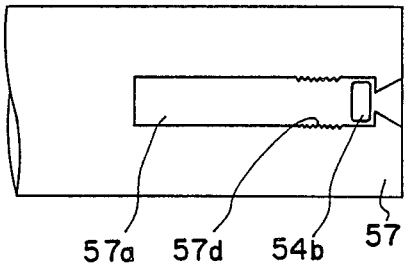

In another modification of the sleeve 57, which is shown in FIG. 20, slopes 57*c* of smaller width than the projection 54*b* are provided to be continuous to the projections 57*b* in the groove 57*a*, so that even after the projection 54*b* goes over the projections 57*b*, the projection 54*b* is moved down pushing open the slopes 57*c*.

In still another modification of the sleeve 57, jagged surfaces 57*d* for imparting a prescribed resistance to the projection 54*b* are provided on a part of the surface of the groove 57*a*. The jagged surfaces 57*d* act to impart the resistance to the projections 54*b* so that the bottom bearer 54 and the sleeve 57 are moved together until the sleeve comes into contact with the bottom pipe 59, and that only the bottom bearer 54 is moved down after the sleeve comes into contact with the bottom pipe.

Figure 22:
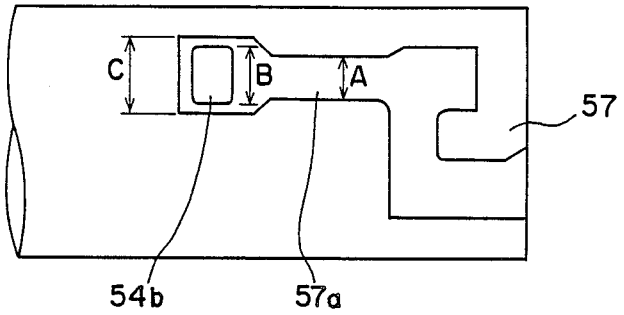

In still another modification of the sleeve 57, which is shown in FIG. 22, a bent groove 57*a* is provided so that the sleeve 57 and the bottom bearer 54 are moved in the same manner as described above. The width "A" of the groove 57*a* is made smaller than that "B" of the projection 54*b* to impart a prescribed resistance to the projection 54*b*. The width "C" of the groove 57*a* is made larger than that "B" of the projection 54*b*. As a result, the sleeve 57 and the bottom bearer 54 are moved in the same manner as described above.

Figure 23:
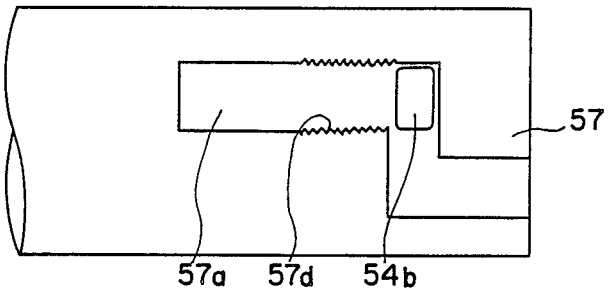

In still another modification of the sleeve 57, which is shown in FIG. 23, a groove 75*a* is provided with jagged surfaces 57*d* for imparting a prescribed resistance to the projection 54*b*.

Figure 24:
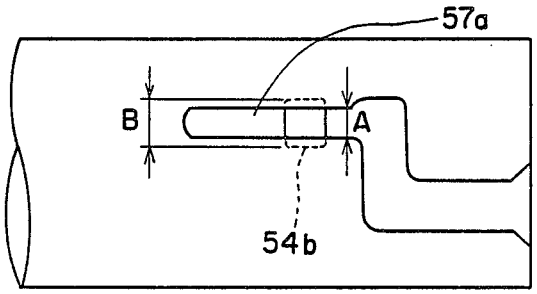

In still another modification of the sleeve 57, which is shown in FIG. 24, a bent groove 57*a* is provided. The width "A" of the groove 57*a* is made smaller than that "B" of the projection 54*b* so that the sleeve 57 and the bottom bearer 54 are moved together until the sleeve comes into contact with the bottom pipe 59, and that only the bottom bearer is moved down after the sleeve comes into contact with the bottom pipe, in the same manner as described above.

Figure 25:
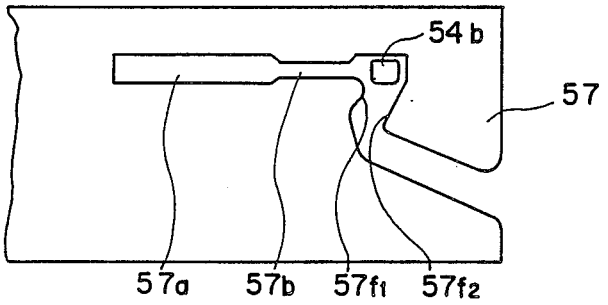

In still another modification of the sleeve 57, which is shown in FIG. 25, a bent groove 57*a* is provided with projections 57*b* and engaging slopes $7f_1$ and $7f_2$ to produce the same effect as described above.

In the modifications shown in FIGS. 19–25, a pair of projections 54*b* and a pair of grooves 57*a* are provided in opposite positions.

In the modification shown in FIG. 18, a distance of b is defined between the top of the sleeve 57 and the flange 54*c* of the bottom bearer 54.

The lead feed mechanism 55 comprises balls 61 held on the ball holding bottom portion 60 of the lead chuck 56 split in two parts, the sleeve 57 fitted with the lead chuck 56 inside the sleeve and engaged at the top thereof with the bottom bearer 54, and a first elastic member 62 urgingly disposed between the sleeve 57 and the engaging step 56*a* of the lead chuck 56 to clamp the lead chuck.

Figure 26:
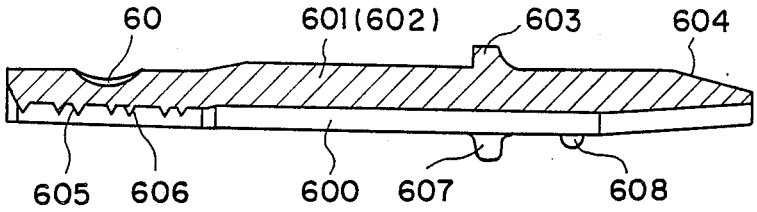
FIGS. 26–30(*a*) and 30(*b*) show main part explanation views of various modifications of the form of the lead chuck of the fifth embodiment.
Figure 27:
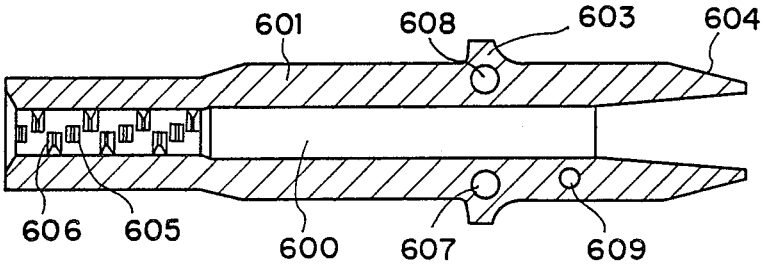
Figure 28:
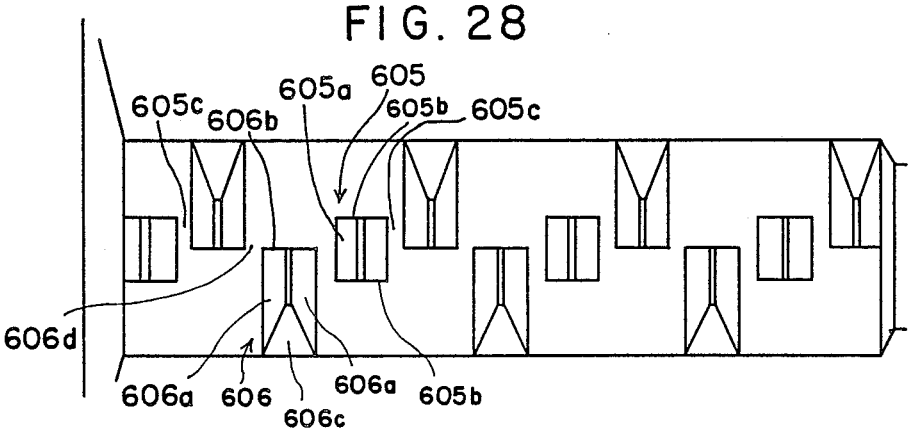
Figure 29:
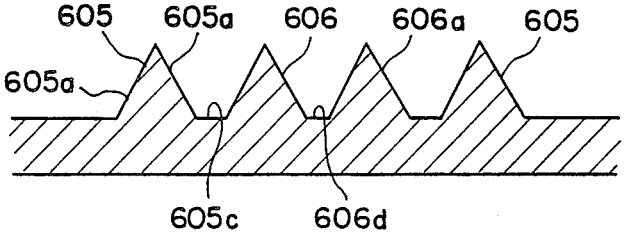

The lead chuck 56 is made of a metal formed by forging, pressing, sinter-alloying, cutting or the like, a synthetic resin formed by injection molding or compressive molding, or the like. The lead chuck 56 comprises a pair of chuck members 601 and 602 two-split along the axis of a lead insertion hole 600 and each having a semicircular section, and has the ball holding portion 60, engaging steps 603 near the top of the lead chuck, a tapered cylindrical top portion 604 extending upwards from the top of the engaging steps 603 and tapered near the top of the portion 604, the lead insertion 600 on the axis of the lead chuck, engaging recesses 607, engaging projections 608, and opening and closing fulcrum projections 609 and 610, as shown in FIGS. 26 and 27, in the fifth embodiment.

The engaging projection 607 of one chuck member 601 is engaged in the engaging recess 609 of the other chuck member 602 so as to prevent the chuck members from becoming discrepant from each other in the axial direction of the lead chuck.

The opening and closing fulcrum projections 609 and 610 of the chuck members 601 and 602 are placed in contact with each other so as to function as fulcra to perform the leverage motion of the chuck members to open and close them, and to function as spacers to define an enough gap of K (refer to FIG. 18) to smoothly perform the leverage motion.

Figure 30:
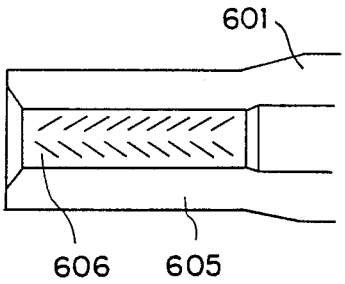
Figure 30:
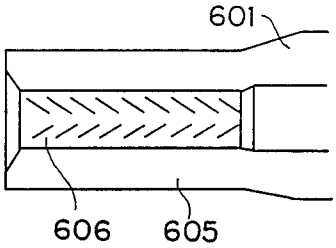

Teeth 605 and 606 are provided on the inside surface of the bottom portion of the lead chuck 56. The teeth 605 and 606 consist of a plurality of central teeth 605 disposed at prescribed intervals on the center lines of the inside circumferential surfaces along the half-split lead insertion holes 600 of the chuck members 601 and 602, and a plurality of side teeth 606 disposed in alternate side positions at prescribed intervals between the central teeth 605. Each of the central teeth 605 comprises an upper and a lower slopes 605*a*, and both vertical end faces 605*b*. Each of the side teeth 606 comprises an upper and a lower slopes 606*a*, an inner vertical end face 606*b*, and an outer end slope 606*c*. The side teeth 606 are overlapped with the central teeth 605 at prescribed intervals in the longitudinal direction of the half-split lead insertion hole 600. The tip of each of the teeth 605 and 606 is sharp. The surfaces 605*c* and 606*d* between the teeth 605 and 606 are flat. Since the teeth 605 and 606 are alternately disposed at the prescribed intervals and the surfaces 605*c* and 606*d* between the teeth are flat, extraneous substances such as lead chips are unlikely to accumulate in the lead chuck 56. The teeth 605 and 606 may have any pattern of disposition such as a divergent or convergent pattern of disposition shown in FIG. 30(*a*), as far as the lead is held well and extraneous substances such as lead chips are effectively prevented from accumulating in the lead chuck. Furthermore, the teeth 605 and 606 may be disposed at intervals upwards, downwards, rightwards and leftwards, or may be disposed continually.

A cylinder 57*h* made of a metal such as stainless steel is fitted in the tapered inside surface 57*g* of the bottom portion of the sleeve 57, if necessary, as shown in FIG. 18, so that the balls 61 held on the top portion of the lead chuck 56 perform rolling contact with sureness, durability and stability, the lead is surely held by the lead chuck 56, and the durability of the sleeve 57 is enhanced.

The cylinder 57*h* may not be provided. If the cylinder 57*h* is not provided, the tapered inside circumferential surface 57*g* is usually shaped to be in rolling contact with the balls 61.

An annular projection 57*i* is provided at the bottom of the tapered inside circumferential surface 57*g* of the sleeve 57 or at the bottom of the metal cylinder 57*h*, if necessary, as shown by dotted lines in FIG. 18, in order to effectively prevent the balls 11 from dropping off.

In the fifth embodiment, the bottom portion of the sleeve 57 is provided with the tapered inside circumferential surface 57*g*, and is not limited thereto and may be provided, otherwise, with parallel inside surfaces almost parallel with the axis of the sleeve.

Figure 31:
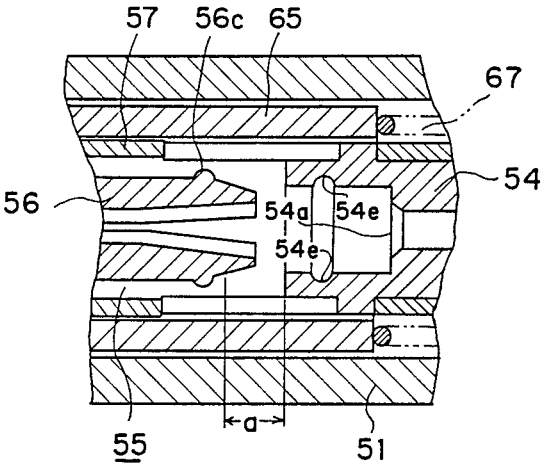
FIG. 31 shows a longitudinally sectional view indicating the engagement of the top of lead chuck and lead pipe bottom bearer of the fifth embodiment.

An engaging projection 56*c*, which is engaged in the engaging recess 54*e* of the bottom bearer 54, may be provided at the top of the lead chuck 56, as shown in FIG. 31. In contrast with that, the lead chuck 56 may have the engaging recess, and the bottom bearer 54 may have the engaging projection. If the engaging projection and the engaging recess are provided, the lead chuck 56 and the bottom bearer 54 are kept from being instantaneously separated from each other at the time of stoppage of bottom pressing, so as to prevent lead feeding operation from becoming insufficient.

When the bottom pressing is performed, the lead chuck 56 is pushed by the bottom bearer 54 so that the lead chuck is moved down into contact with the bottom pipe 59. The lead chuck 56 is thereafter moved down further while being opened by the engagement of the top of the lead chuck and the bottom hole 54*a* of the bottom bearer 54, so as to feed the lead.

Even after the bottom pressing is stopped, the recess 54*e* and the projection 56*c* remain engaged with each other until the outside step 7*j* of the sleeve 57 is moved up into contact with the inside step 65*a* of a frame 65. During that time, the lead chuck 56 is opened so as to smoothly feed the lead.

Although the lead chuck 56 is split in two parts in the fifth embodiment, the lead chuck may be split in three or more parts or may be an unsplit single body. It is preferable to provide the mutual contact sections of the split members of the lead chuck 56 with engaging projections and recesses, anti-slipping jags or the like to prevent the members from becoming discrepant from each other in the axial direction of the lead chuck.

Since a part of the diameter of the lead chuck 56 is very approximate to the inside diameter of the frame 65 and the first elastic member 62 is surely engaged with the engaging step 56*a* of the lead chuck 56, the lead chuck is surely prevented from playing or deviating upwards, downwards, rightwards and leftwards. The ball holding portion 60 of the lead chuck 56 may be constituted by holes for holding the balls 61 or the balls may be housed not to drop off. The balls 61 are rotatable on the ball holding portion 60.

The first elastic member 62 has a weaker urging force than a second elastic member 63 described hereinafter.

The lead feed mechanism 55 is almost entirely housed in the frame 65, which is disposed in the outer pipe 51 so that the frame can be slid in the axial direction thereof. The frame 65 is urged downwards by a third elastic member 67. The bottom pipe 59 is provided at the bottom of the frame 65. An inside step 65*a* is provided on the inside surface of the frame 65. An outside step 65*b* is provided on the outside surface of the frame 65.

A distance of c is defined between the top 59*a* of the bottom pipe 59 and the bottom of the sleeve 57. The distance of c corresponds to the fed quantity of the lead fed by the top pressing, as described hereinafter. The bottom pipe 59 is fitted on the bottom of the frame 65. The bottom pipe 59 comes into contact with the bottom of the moved-down lead chuck 56 so as to perform a function of stopping the lead chuck 56 and a function of pushing the top of a slider 66. The bottom pipe 59 can be made of any material as far as the material is appropriate to perform the functions.

The inside step 65*a* of the frame 65*a* of the frame 65 is engaged with the outside step 57*j* of the sleeve 57 when writing is performed, so that the sleeve is pushed downwards by the frame 65 urged downwards by the third elastic member 67 resisting the pressure of the writing. The third elastic member 67 has three functions as follows:

① A function of preventing the lead pipe 53 from playing

② Although the urging force of the third elastic member 67 is stronger than normal writing pressure, the member 67 has a buffer function of retracting the frame 65 if excessive writing pressure should act to the lead 64.

③ If an eraser (not shown in the drawings) is provided at the top of the lead pipe 53, the member 67 has a function of supporting the eraser when it is in use.

A compressive force acts to the third elastic member 67 by the frame 65 moved up by bottom pressing in lead feeding operation described hereinafter. It is preferable that the eraser supporting function, in which the lead pipe 53 is urged upwards, is performed by a prescribed strong urging force, and the frame 65 is urged downwards by a prescribed weak urging force in order to smoothly and lightly perform the bottom urging.

A distance of d is defined between the outside step 65*b* of the frame 65 and the stopper step 51*a* of the outer pipe 51 so that the maximum distance through which the frame 65 is moved up is limited to the stopper step 51*a*.

The slider 66 is disposed in the bottom member 52 so that the slider can be moved in the axial direction thereof. The slider 66 comprises a slider body 69, in the center of which a slide pipe 68 is fitted, and a friction member 70 fitted in the slider body 69 to apply a prescribed frictional force to the lead 64, as shown in FIG. 18. The slider 66 is urged downwards by the second elastic member 63 engaged on a bearer 71 secured at the top thereof to the bottom member 52.

Figure 32:
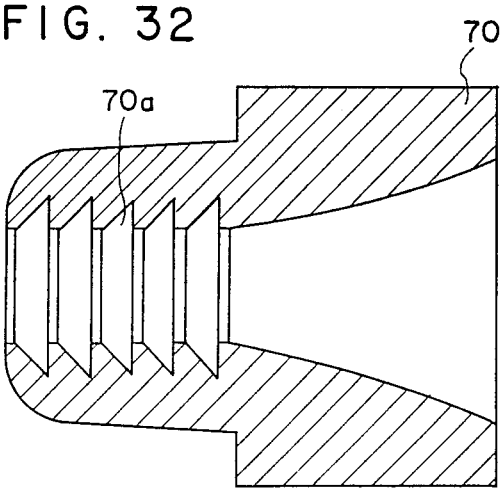
FIG. 32 shows an enlarged longitudinally-sectional view of a friction member provided in the slider of the fifth embodiment.

The prescribed frictional force, which is applied to the lead 64 by the friction member 70, is stronger than the urging force of the first elastic member 62 and slightly stronger than that of the second elastic member 63, when automatic lead send-out operation described hereinafter is performed. The friction-causing portion 70*a* of the friction member 70 is made of teeth inclined downwards as shown in FIGS. 18 and 32, so as to enable the smooth downward movement of the lead 64 but to hinder the easy upward movement thereof by the frictional force.

A projection 69*b*, which is engaged with the inside annular projection 71*a* of the bearer 71 as shown in FIG. 18, is provided as a means for stopping the slider 66 for a prescribed time. A slit S is provided in the peripheral surface of the slider body 69, as shown in FIG. 18.

A distance of f is defined between the top of the slider 66 and the bottom pipe 59 as the slider 66 is unretracted, as shown in FIG. 18. The distance of f serves to enable writing through automatic lead feeding operation which is a second kind of the lead feeding operation described hereinafter. The distance of f corresponds to the fed quantity of the lead fed by a first kind of the lead feeding operation, which is performed by the bottom pressing.

A distance of g is defined between the inside annular projection 71*a* and the bottom of the projection 69*b* so that these projections are engaged with each other through the distance of g.

The distances of a, d and g have a relation to each other as $a>d>g$.

The lead feeding operation according to the present invention is hereafter described. There are three kinds of the lead feeding operation as follows:

(1) The first kind of the lead feeding operation is conventional lead feeding operation, which is performed by pressing the top of the lead pipe 53. The sleeve 57 engaged with the bottom bearer 54 is moved down together with the lead pipe 53 and so forth by the pressing of the top of the lead pipe 53, and then stopped by coming into contact with the bottom of the bottom pipe 59. However, the bottom bearer 54 integrally coupled with the lead pipe 53 is pushed and moved down further while slipping on the inside surface of the sleeve 57, so as to push the top of the lead chuck 56 downwards to feed the lead in a conventional manner.

(2) The second kind of the lead feeding operation is the automatic lead feeding operation, which is performed by stopping writing.

Figure 33:
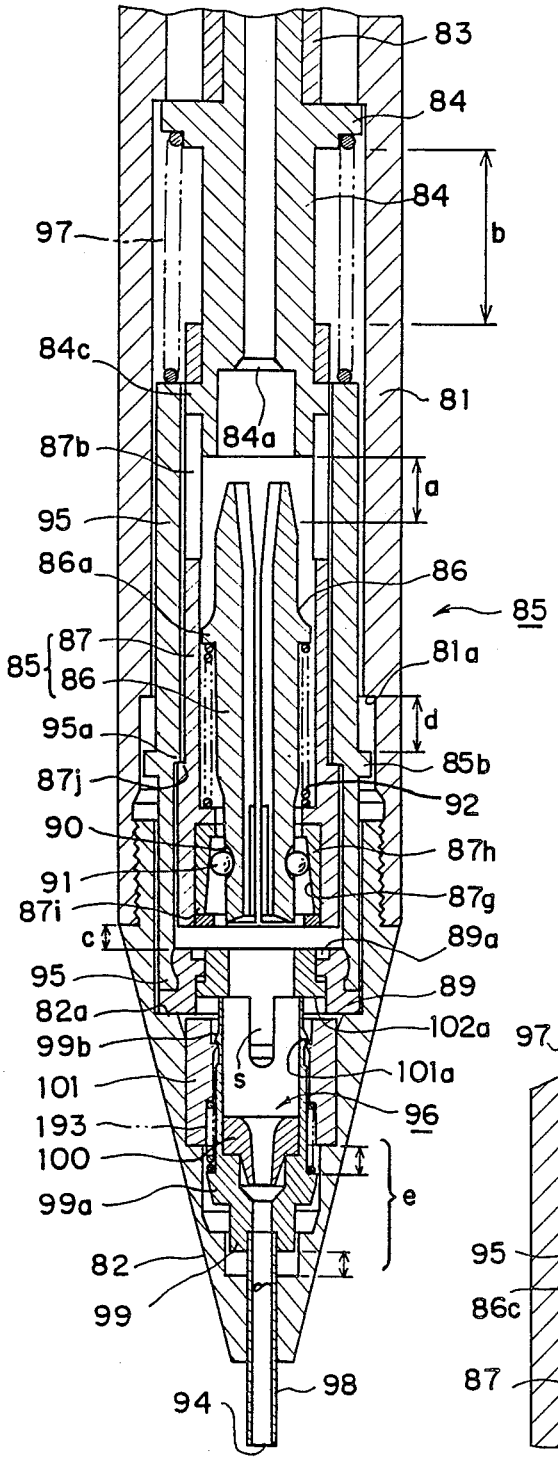
FIG. 33 shows a longitudinally sectional view of a lead feed mechanism for a mechanical pencil, which is a sixth embodiment of the present invention.

A sixth embodiment of the present invention is hereafter described with reference to the drawings. In this embodiment, a bottom member 82 is provided at the bottom of an outer pipe 81, and a lead pipe 83 is disposed in the outer pipe so that the lead pipe can be slid down in the axial direction thereof, as shown in FIG. 33. A bottom bearer 84 is fitted on the bottom of the lead pipe 83. A lead feeding mechanism 85 is provided so that a contact distance of a is defined between the bottom of the bottom bearer 84 and the mechanism 85.

The bottom bearer 84 has a bottom hole 4*a*, in which a lead chuck 86 described hereinafter is engaged by pushing. The bottom bearer 84 is movably engaged with a sleeve 87. Any construction for engaging the bottom bearer 84 and the sleeve 87 with each other can be used as far as the bearer 84 and the sleeve 87 are moved together until the sleeve comes into contact with a bottom pipe 89, and only the bearer is moved down after the sleeve comes into contact with the bottom pipe. Various constructions as described for the fifth embodiment are available for the engagement of the bearer 84 and the sleeve 87.

The lead feed mechanism 85 comprises balls 91 held on the ball holding bottom portion 90 of the lead chuck 86 split in two parts, a sleeve 87 fitted in the lead chuck and engaged at the top of the sleeve with the bottom bearer 84, and a first elastic member 92 urgingly engaged between the sleeve 87 and the engaging step 86*a* of the lead chuck so as to clamp the lead chuck.

Figure 34:
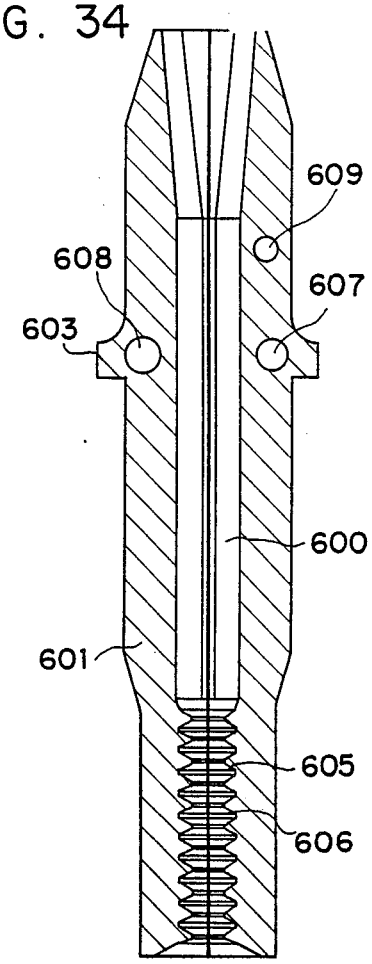
FIG. 34 shows an enlarged longitudinally-sectional view of the details of the lead chuck of the sixth embodiment.

The lead chuck 86 is made of a metal formed by forging, pressing, sinter-alloying or the like, a synthetic resin formed by injection molding or compressive molding, or the like. Various anti-slipping constructions as described for the fifth embodiment with reference to FIGS. 26–30(*a*) and 30(*b*) are available for the lead chuck 86. The teeth 605 and 606 of the lead chuck 86 may be disposed at vertical and/or sideward intervals, or may be disposed continually as shown in FIG. 34.

A cylinder 87*h* made of a metal such as stainless steel is fitted in the tapered inside surface 87*g* of the bottom portion of the sleeve 87, if necessary, as shown in FIG. 33, so that the balls 91 held on the bottom portion of the lead chuck 86 perform rolling contact with sureness, durability and stability, a lead is surely held by the lead chuck 86, and the durability of the sleeve is enhanced. The metal cylinder 87*h* may not be provided. For ordinary use, the tapered inside surface 87*g* may be formed to be in rolling contact with the balls 91 so as to dispense with the metal cylinder 87*h*. An annular lid 87*i* may be provided at the bottom of the tapered inside surface 87*g* of the sleeve 87 or on the inside surface of the bottom portion of the metal cylinder 87*h*, as shown in FIG. 33, so as to effectively prevent the balls 91 from dropping off.

In the sixth embodiment, the bottom portion of the sleeve 87 is provided with the tapered inside surface 87*g*, but is not limited thereto and may be provided, otherwise, with parallel inside surfaces nearly parallel with the axis of the sleeve.

Figure 35:
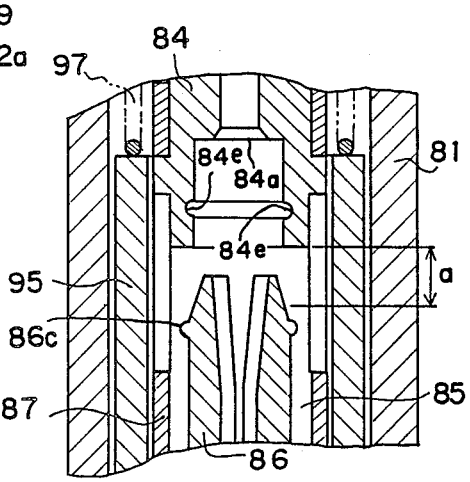
FIG. 35 shows a partial longitudinally-sectional view of an engagement construction for the lead pipe bottom bearer and top of lead chuck of the sixth embodiment.

An engaging projection 86*c*, which is engaged in the engaging recess 84*e* of the bottom bearer 84, may be provided at the top of the lead chuck 86, as shown in FIG. 35. In contrast with that, the lead chuck 86 may have the engaging recess, and the bottom bearer 84 may have the engaging projection. If the projection 86*c* and the recess 84*e* are provided, the lead chuck 86 and the bottom bearer 84 are kept from being instantaneously separated from each other at the time of stoppage of pressing, so as to prevent lead feeding operation from becoming insufficient.

When the pressing is performed, the lead chuck 86 is pushed by the bottom bearer 84 so that the lead chuck is moved down to push down the top of a movable pipe 102 described hereinafter. The movable pipe 102 pushes down a slider 96 and comes into contact with the top of a bearer 101. After that, the lead chuck 86 is moved down while being opened by the engagement of the bottom hole 84*a* of the bottom bearer 84 and the top of the lead chuck, so as to send out the lead. Even immediately after the pressing is stopped, the recess 84*e* and the projection 86*c* remain engaged with each other until the outside step 87*j* of the sleeve 87 is moved up into contact with the inside step 95*a* of a frame 95. During that time, the lead chuck 86 is opened to smoothly fed the lead.

In the sixth embodiment, the lead chuck 86 is split in two parts, but may be split three or more parts or may be an unsplit single body. It is preferable to provide the mutual contact sections of the lead chuck 86 with mutually engaged projections and recesses, anti-discrepancy jags or the like in order to prevent the axial discrepancy of the sections of the lead chuck 86. Since a part of the diameter of the lead chuck 86 is very approximate to the inside diameter of the frame 95 and the top of the first elastic member 92 is surely engaged with the engaging step 86 of the lead chuck 86, the lead chuck is certainly prevented from playing or becoming discrepant vertically and sidewards. The ball holding portion 90 of the lead chuck 86 may be constituted by simple holes for holding the balls 91 or have a construction for housing the balls 91 not to drop off. The balls 91 are rotatable on the ball holding portion 90.

The first elastic member 92 has a weak urging force than a second elastic member 93 described hereinafter.

The lead feed mechanism 85 is almost entirely housed in the frame 95, which is disposed in the outer pipe 81 so that the frame can be slid in the axial direction thereof. The frame 95 is urged downwards by a third elastic member 97. A bottom pipe 89 is provided at the bottom of the frame 95. An inside step 95*a* is provided on the inside surface of the frame 95. An outside step 95*b* is provided on the outside surface of the frame 95.

A distance of c is defined between the bottom pipe 89 and the bottom of the sleeve 87, as shown in FIG. 33. The distance of c corresponds to the fed quantity of the lead fed by bottom pressing described hereinafter. The bottom pipe 89 is fitted on the bottom of the frame 95 so as to perform a function of coming into contact with the bottom of the moved-down sleeve 87 and stopping the sleeve, and a function of holding the movable pipe 102 under prescribed fitting pressure, coming into contact with the top of an outside engaging step 102 and stopping the movable pipe in a moved-up position, as described hereinafter. The bottom pipe 89 may be made of any material as far as the material enables the bottom pipe to perform the functions.

Figure 38:
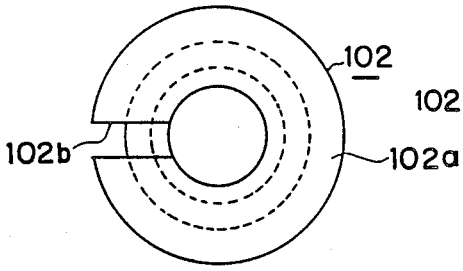
FIG. 38(*a*) shows a bottom view of a movable pipe slidably fitted in the cylindrical member of the sixth embodiment.
Figure 38:
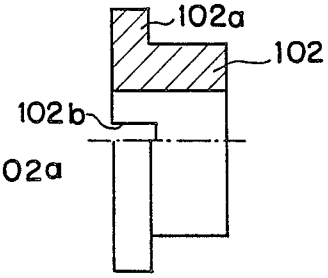

The movable pipe 102, whose outside diameter is almost equal to the inside diameter of the inside engaging step 89*a* of the bottom pipe 89, is fitted on the step 89*a* so that the movable pipe can be slid in the axial direction thereof, as shown in FIG. 33. An annular outside engaging step 102*a*, whose outside diameter is almost equal to the inside diameter of the bottom pipe 89, is provided at the bottom of the movable pipe 102, as shown in FIGS. 38(*a*) and 38(*b*). The outside engaging step 102*a* is fitted on the inside circumferential surface of the bottom pipe 89 under prescribed fitting pressure (frictional resistance) so that the movable pipe 102 can be slid in the axial direction thereof. The movable pipe 102 is provided with a slit 102*b*, if necessary, so that the pressure for fitting the movable pipe and the bottom pipe 89 on each other is equal to a prescribed level, and the axial sliding of the movable pipe is ensured. The movable pipe 102 functions so that the top of the outside engaging step 102*a* of the movable pipe comes into contact with the bottom of the inside engaging step 89*a* of the bottom pipe 89 to restrain the upward the upward movement of the slider 96 into a locked state described hereinafter, that is, to stop the upward movement in a locked position, and that the movable pipe 102 is pushed by the bottom of the moved-down lead chuck 86 and moved down against the fitting pressure so as to move down the slider 96 to unlock it, as described hereinafter. The pressure (for example, 400 g plus/minus 50 g) for fitting the movable pipe 102 and the bottom pipe 89 on each other is weaker than the urging force (for example, 500 g to 550 g) of the third elastic member 97, and stronger than the pressure (for example, 200 g plus/-minus 50 g) for fitting the projection 99*b* of the slider 96 and the inside annular projection 101*a* of a bearer 101 on each other. For that reason, the slider 96 locked by the inside annular projection 101*a* is unlocked by being pushed by the movable pipe 102 moved by the urging force of the third elastic member 97, as described hereinafter.

The inside step 95*a* of the frame 95 remains engaged with the outside step 87*j* of the sleeve 87 as writing is performed. For that reason, the sleeve 87 is pushed downwards by the frame 95 urged downwards by the third elastic member 97 resisting the pressure of the writing.

The third elastic member 97 has three functions as follows:

① A function of preventing the lead pipe 83 from playing

② Although the urging force of the member 97 is stronger than normal writing pressure, the member 97 has a buffer function of retracting the frame 95 if excessive writing pressure should act to the lead 94 in writing.

③ If an eraser (not shown in the drawings) is provided at the top of the lead pipe 83, the third elastic member 97 has a function of supporting the eraser when it is in use.

A compressive force is applied to the third elastic member 97 by the frame 95 moved up by bottom pressing in lead feeding operation described hereinafter. It is preferable that the eraser supporting function, in which the lead pipe 83 is urged upwards, is performed by a prescribed strong urging force, and the frame 95 is urged downwards by a prescribed weak urging force in order to lightly and smoothly perform the bottom pressing.

The slider 96 is disposed in the bottom member 82 so that the slider can be moved in the axial direction thereof. The slider 96 comprises a slider body 99, in the center of which a slider pipe 98 is fitted, and a friction member 100 fitted in the slider body 99 to apply a prescribed frictional force to the lead 94. The frictional force (described hereinafter), which is applied to the lead 94 by the friction member 100 to hinder the upward movement of the lead, is 20 g to 30 g, and is stronger than the urging forces of the first and the second elastic members 92 and 93 and weaker than that of the third elastic member 97 and the pressure for fitting the movable pipe 102. The slider 96 is urged downwards by the second elastic member 93 engaged on the bearer 101 secured at the top thereof to the bottom member 82.

Figure 36:
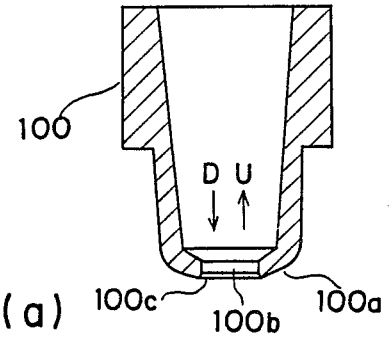
FIG. 36 shows a longitudinally sectional view of a friction member provided in the slider of the sixth embodiment.
Figure 37:
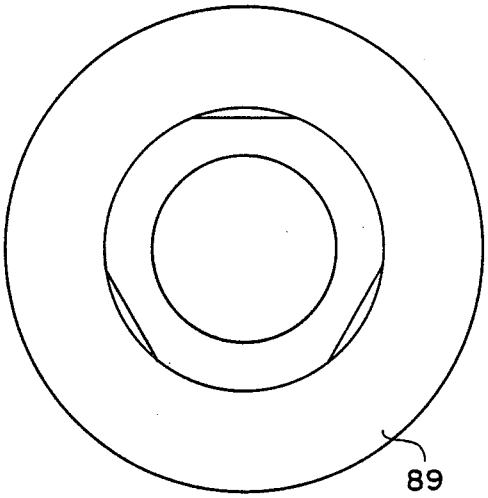
FIG. 37(*a*) shows a bottom view of a cylindrical member for pushing the slider of the sixth embodiment.
Figure 37:
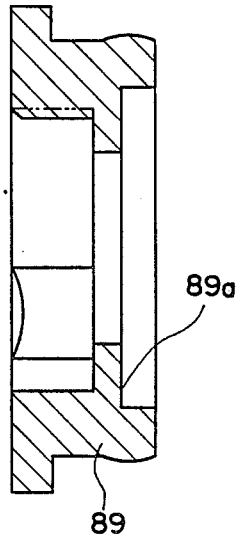

The friction member 100 exerts the prescribed frictional force on the lead 94, as shown in FIG. 36. The frictional force, which the friction member 100 exerts on the lead in automatic lead feeding operation described hereinafter, is stronger than the urging force of the first elastic member 92, and slightly stronger than the second elastic member 93. The friction member 100 has a friction-causing portion 100*a* for applying the prescribed frictional force to the lead 94. The friction-causing portion 100*a* is provided at the bottom of the friction member 100 so as to have a tapered outside surface. The portion 100*a* has a primary friction hole 100*b*, and a tapered secondary friction hole 100*c* extending from the bottom of the primary friction hole and tapered upwards. When the lead 94 is moved down as shown by an arrow D in FIG. 36, the friction-causing portion 100*a* is scarcely deformed so that a frictional force (hereinafter referred to as downward movement frictional force) is applied to the lead 94 by only the primary friction hole 100*b*. When the lead 94 is moved up as shown by an arrow U in FIG. 36, the frictioncausing portion 100*a* is deformed so that the inside circumferential surface of the secondary friction hole 100*c* becomes almost flush with that of the primary friction hole 100*b* and all of the inside circumferential surfaces of the holes 100*b* and 100*c* come into contact with the lead 94. For that reason, the lead 94 can be smoothly moved down, but a frictional force (hereinafter referred to as upward movement frictional force) is applied to the moved-up lead 94 to prevent the lead from being easily moved up.

A projection 99*b*, which is engaged with the inside annular projection 101*a* of the bearer 101 as shown in FIG. 33, is provided as an engagement means for stopping the slider 96 in the locked moved-up position. A slit S is provided in the peripheral surface of the slider body 99.

The lead feeding operation of the sixth embodiment is hereafter described. There are three kinds of the lead feeding operation as follows:

(1) The first kind of the lead feeding operation is conventional lead feeding operation, which is performed by pressing the top of the lead pipe 83. When the top of the lead pipe 83 is pressed, the sleeve 87 engaged with the engaging bearer 84 is moved down together with the lead pipe and so forth to send the lead until the sleeve comes into contact with the top of the bottom pipe 89. After the sleeve 87 comes into contact with the top of the bottom pipe 89, the sleeve is stopped. In a case (i) that the slider 96 is not in a state locked by the bearer 101 (refer to FIG. 39) as described hereinafter, the lead feeding operation is conventionally performed by the top pressing. In another case (ii) that the slider 96 is in a state locked by the annular projection 101*a* of the bearer 101 (refer to FIGS. 33 and 40), the lead feeding operation is performed, by the top pressing, in the same manner as the case (i) until the bottom of the sleeve 7 comes into contact with the top of the bottom pipe 89 through the distance of c. After the sleeve comes into contact with the top of the bottom pipe through the distance of c, the movable pipe 102 is pushed by the downward movement of the lead chuck 86 and the slider 96 is simultaneously pushed down, so that the slider 96 goes over the annular projection 101*a* of the bearer 101 and is thus unlocked. After that, the slider 96 is urged and moved down by the second elastic member 93 so that the slider pipe 98 is protruded from the bottom member 82. In that process, the lead 94 supported by the upward movement frictional force of the friction member 100 is pulled out down from the lead chuck 86 and moved down together with the slider 96. As a result, the lead 94 is always protruded from the bottom of the slider pipe 98, by a length of c appropriate to writing. As described above, the unlocking operation and the lead feeding operation are simultaneously performed by pressing the top of the slider 96, so as to assure that the lead 94 is protruded from the slider pipe 98, by the length of c appropriate to the writing. For that reason, the writing can be performed as the lead 94 is being confirmed.

Figure 39:
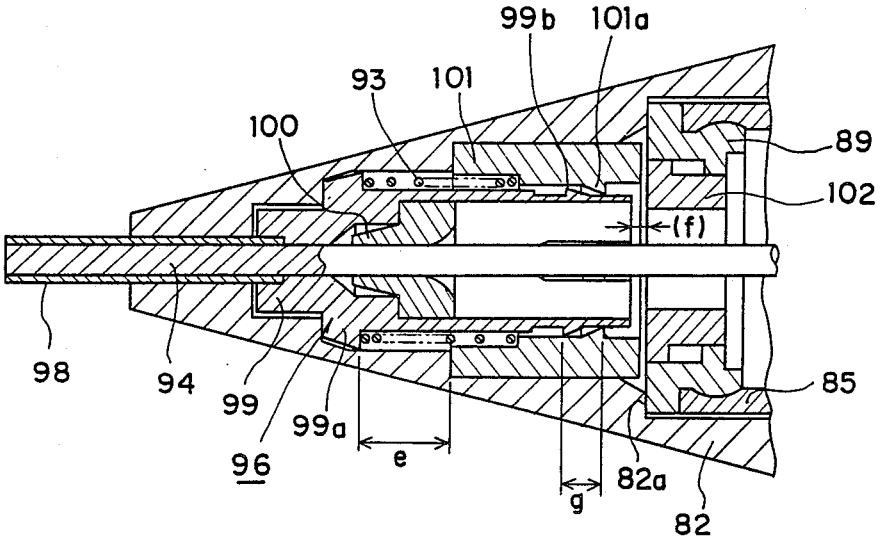
FIGS. 39–45 show longitudinally sectional views for describing the lead feeding operation of the sixth embodiment.
Figure 42:
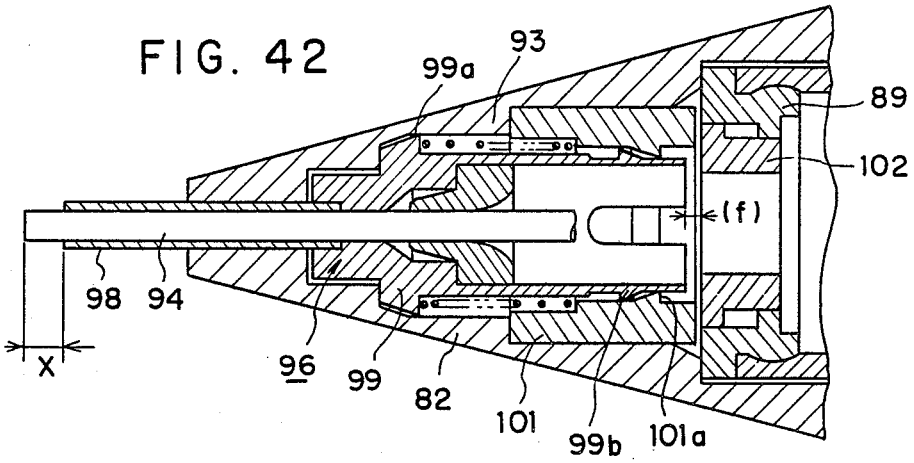
Figure 44:
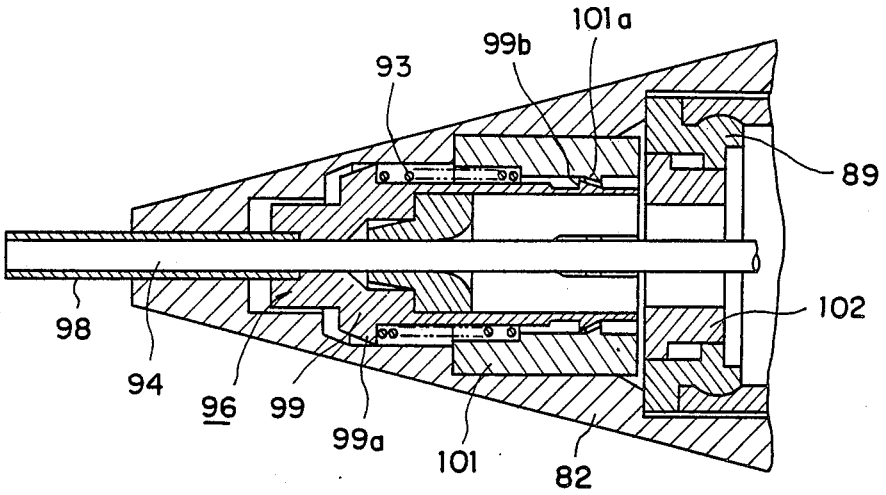

(2) The second kind of the lead feeding operation is automatic lead feeding operation, which is automatically performed by stopping the writing. Normally, the writing is performed as the lead 94 remains protruded by a prescribed quantity of X from the slider pipe 98 as shown in FIG. 42. As the writing is continued, the lead 94 is gradually worn and becomes flush with the bottom of the slider pipe 98 as shown in FIG. 39. Even in that state, the slider 96 can be moved up against the urging force of the second elastic member 93 so that the slider 96 can be moved up by a distance of f ($f<e$; refer to FIG. 39) to the maximum until the top of the slider 96 comes into contact with the movable pipe 102. It takes a very long time of writing for the worn length of the lead 94 to become equal to the upward movement distance of f. When an ordinary adult normally writes five alphabetical characters on good-quality paper with a mechanical pencil having a lead of HB in hardness and 0.5 mm in diameter, the lead is worn by only about 0.01 mm. Therefore, it is usually impossible that the writing is incessantly continued to move up the slider 96 through the upward movement distance of f. For that reason, the writing should be thought to be surely stopped halfway. Then, let's suppose that the writing is stopped in a state shown in FIG. 44, and the bottom of the slider pipe 98 is separated from the surface of writing paper. The slider 96 is moved down by the urging force of the second elastic member 93, and the lead 94 is pulled downwards together with the slider 96 by the prescribed frictional force imparted from the friction member 100. Since the clamping force on the lead chuck 86 pinching the lead 94 is exerted by the first elastic member 92 of weaker urging force than the second elastic member 93, the lead chuck is compressed by the pulling force oriented to move down the lead 94, so that the lead chuck is allowed to be moved down as a whole. As the lead chuck is moved down in that way while the balls 91 on the bottom portion of the lead chuck roll in contact with the tapered inside surface 87*g* of the sleeve 87, the clamping force on the lead chuck decreases so as to feed the lead 94. Because of such a series of operation, a state shown in FIG. 39 is established again to automatically perform the lead feeding operation to enable the writing through the upward movement distance of f to the maximum.

Figure 43:
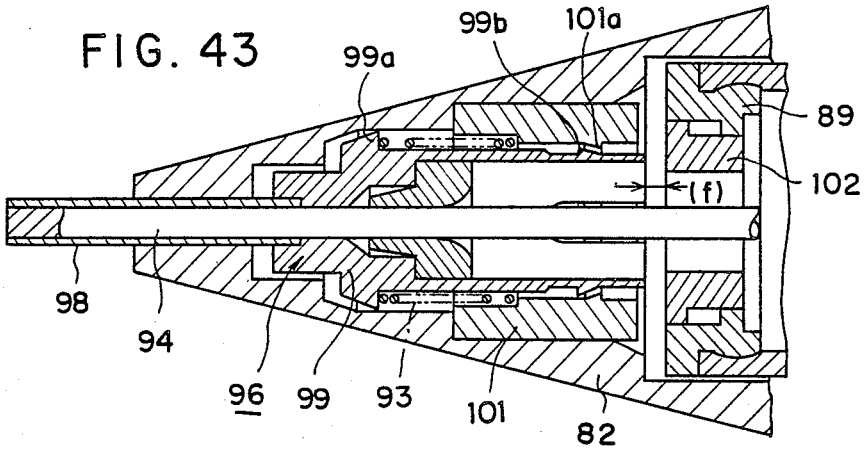
Figure 45:
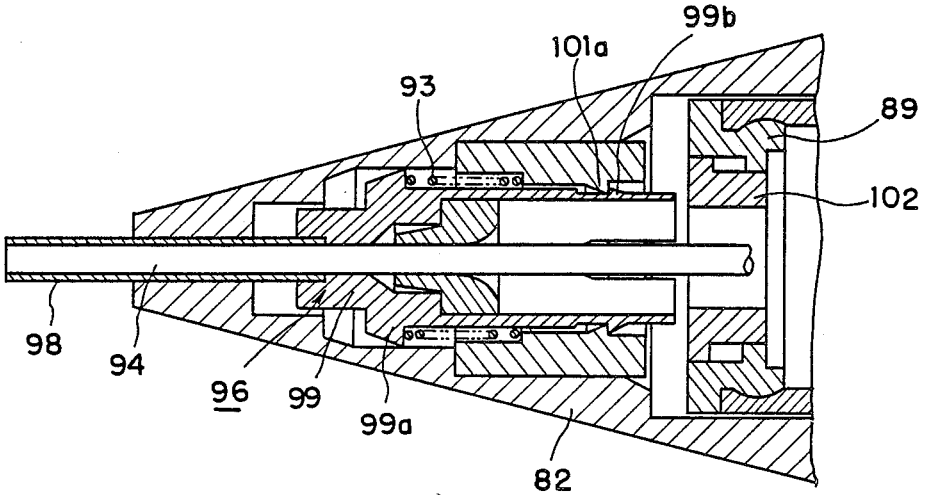

(3) The third kind of the lead feeding operation is performed by pressing the bottom of the slider 96 onto the surface of the writing paper. The bottom of the slider 96 is pressed in two different manners as follows:

(i) The first manner is pressing the bottom of the slider 96 as the lead 94 is unprotruded from the bottom of the slider pipe 98. As a result of pressing the bottom of the slider 96, the lead 94 is always protruded from the slider pipe 98, by a length equal to the distance of f, as shown in FIG. 42 (X=f). Since the bottom is pressed, the lead chuck 86 is moved up pinching the lead 94, as shown in FIG. 43, and the slider 96 is also moved up. The moved-up quantities of the lead chuck 86 and the slider 96 are equal to each other. The lead chuck and the slider can be moved up through the distance of c to the maximum, at which the projection 99*a* of the slider comes into contact with the bottom of the bearer 101. Distances of e and d have a relation to each other as e<d. Since the distances of a and d shown in FIG. 33 have a relation to each other as a>d, the top of the lead chuck 86 never comes into contact with the bottom bearer 84 as the lead chuck is moved up. For that reason, the lead chuck keeps pinching the lead 94. The frame 95 and the bottom pipe 89 are moved up against the urging force of the third elastic member 97 through the action of the inside and the outside steps 95*a* and 87*j* as the lead chuck 86 is moved up. The distances of a, e and g have a relation to each other as a>e>g in the upward movement of the slider 96. The distance of g is defined between the inside annular projection 101*a* and the bottom of the projection 99*b*. When the slider 96 is moved up by the distance of e to the maximum, the projection 99*b* of the slider body 99 first goes over the inside annular projection 101*a*, and the top of the slider body 99 then projects from the top of the bearer 101. At that time, the frame 95 and the lead feed mechanism 85 are moved up through the same distance as the slider body 99 as the lead 94 remains pinched. For that reason, the distance of f is maintained between the top of the slider body 99 and the bottom pipe 89. The bottom of the slider 96 is then separated from the surface of the writing paper. As a result, the frame 95 and the lead feed mechanism 85 including the sleeve 87, the lead chuck and so forth are moved chiefly by the urging force of the third elastic member 97 until the bottom pipe 89 comes into contact with the step 82*a* of the bottom member 82. At that time, the slider 96 remains temporarily stopped by its projection 99*b* engaged with the inside annular projection 101*a* as shown in FIG. 45. Since the lead send-out mechanism 85 is moved down pinching the lead 94 even during the temporary stoppage of the slider 96, the lead 94 is pushed, by a length of f, into the friction member 100 of the slider 96. After that, the pushed movable pipe 102 comes into contact with the top of the slider body 99 by the third elastic member 97 so as to eliminate the engagement for the above-mentioned temporary stoppage. At that moment, the slider 96 is moved down by the urging force of the second elastic member 93, the lead 94 held by the lead chuck 86 is pulled out by the friction member 100 (upward movement frictional force) in the slider 96, the slider is returned to its original position, and the lead 94 protrudes by a length of f from the bottom of the slider pipe 98.

(ii) The second manner is pressing the bottom of the slider 96 as the lead 94 remains protruded from the bottom of the slide pipe 98. In the second manner, the lead 94 is always protruded by a length of f from the slider pipe 98 if the protruded quantity "X" of the lead and the distances of d and g have a relation to each other as $X \leqq (d-g)$. Let's substitute concrete numerical values for easy understanding. Let's suppose that f, g, d and X are 0.8 mm, 1.3 mm, 1.7 mm and 0.3 mm ($<d-g=0.4$ mm), respectively. When the bottom of the slider 96 is pressed, only the lead send-out mechanism 85 and the frame 95 are first moved up together with the lead 94 through the upward movement distance of X. The slider 96 and the movable pipe 102 are then moved up together with the lead feed mechanism 85 and the frame 95 as the lead 94 remains pinched, alike to the first manner. For that reason, the moved-up quantity of the lead chuck 86 is made by X (which is equal to 0.3 mm) larger than that of the slider 96, so that the distance through which the slider 96 can be moved up is limited by the frame 95 whose moved-up quantity is limited by a stopper step 81*a*. As a result, the slider 96 can be moved up further through only a distance of d−g (which is equal to 1.7−1.3=0.4 mm). That is because the slider 96, the frame 95 and the lead feed mechanism 85 need to be moved up together as the lead 94 remains pinched by the lead chuck 86. In that upward movement, the projection 99*b* goes over the inside annular projection 101*a* of the bearer 101. When the slider 96 pressed onto the surface of the writing paper is separated therefrom, the lead feed mechanism 85 is moved down pinching the lead 94, alike to the first manner. As a result, the lead 94 is protruded by a length of f from the bottom of the slider pipe 98, completely alike to the first manner. If there is a condition of $X>d-g=0.4$ mm, the frame 95 restricted at the top thereof by the stopper step 81*a* keeps the slider 96 from being moved up to be engaged with the inside annular projection 101*a*, so that the slider 96 is never stopped by becoming engaged with the projection 101*a* of the bearer 101. For that reason, the adjustment of the protruded quantity of the lead as described above is not performed. In other words, the lead is not fed no matter how many times the bottom of the slider is pressed. Therefore, the lead 94 remains protruded in the unchanged quantity of X. This means that the relation between the distances of d and g can be designed depending on a lead diameter of 0.3 mm, 0.5 mm or the like so as to prevent the lead 94 from being excessively sent out by the pressing of the bottom and from being broken in writing, once the lead 94 is protruded from the slider pipe 98 by a length appropriate to the writing. An economic mechanical pencil of easy use can thus be provided.

Figure 40:
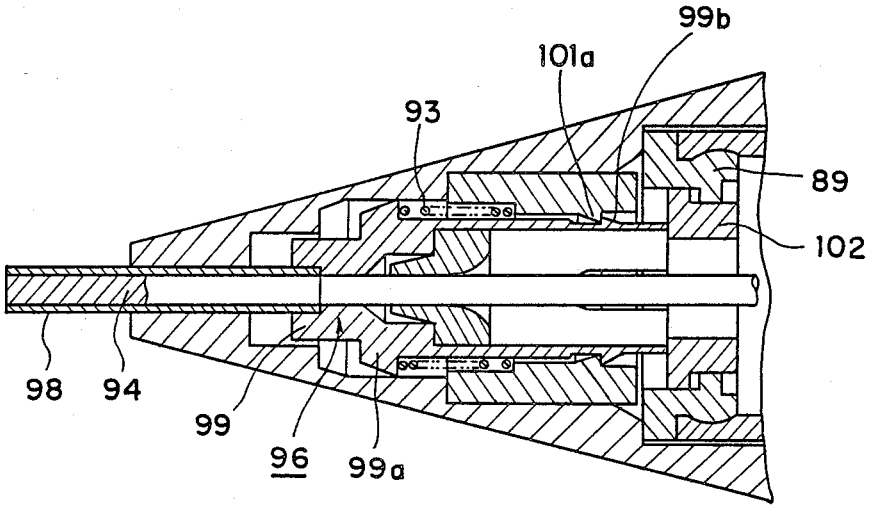
Figure 41:
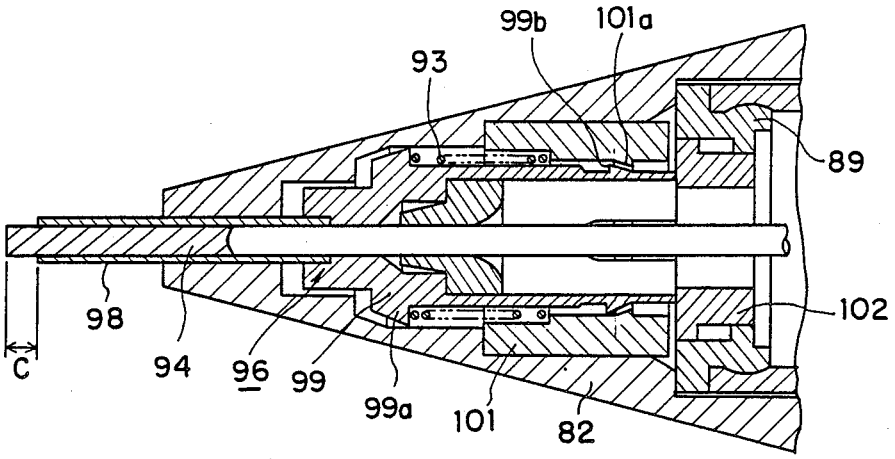

The unused state of the mechanical pencil is hereafter described. In an unlocked state, the top of the lead pipe 93 is pressed (the lead 94 remains released from the lead chuck 86 so that the frame 95 and the lead feed mechanism 85 are not moved up, differently from the above-described bottom pressing) and the slider pipe 98 is pushed onto the surface of the writing paper or the like so that the slider 96 is housed in a locked state inside the bottom member 82. At that time, the slider 96 is moved up pushing the movable pipe 102 upwards. Since the pressure which pushes the slider pipe 98 onto the paper surface or the like is higher than that which fits the movable pipe 102 and the bottom pipe 89 on each other, the movable pipe 102 is pushed upwards as shown in FIG. 40. Since the urging force of the third elastic member 97 is designed to be stronger than the fitting pressure for the movable pipe 102 and the bottom pipe 89, the lead feed mechanism 85 is not moved. For that reason, locking operation can be smoothly performed. In the locking operation, the projection **99*b* of the slider 96 goes over the annular projection 101*a* of the bearer 101 and is stopped by engagement so that the slider 96 is locked in the engagement-stopped position thereof. Even if an external force acts to the locked slider 96, it is not unlocked, so that the lead is prevented from being unexpectedly protruded or retracted due to the movement of the unlocked slider as in a conventional mechanical pencil. However, the slider 96 can be easily unlocked by pressing the top of the lead pipe 83**, as described with regard to the first manner of the bottom pressing.

It will be understood from the above detailed description that the lead feed mechanism of a mechanical pencil provided according to the present invention have various effects as follows:

(1) Since a slider is surely stopped by engagement with a cylindrical fixed member when the slider is slid up following the pushing-in of a lead, the slider is kept in a prescribed position until the slider is returned to perform lead feeding operation. For that reason, the lead is surely fed.

(2) The top portion of a lead chuck consists of sections extending obliquely upwards away from the lead so that a prescribed elastic force can be applied to the top portion. For that reason, as soon as the top portion comes into contact with a bottom bearer for a lead pipe, the prescribed elastic force is applied to the top portion to instantaneously push open the lead pinching surfaces of the lead chuck. As a result, the lead can be not only surely pinched but also surely fed.

(3) Because of the above-described construction, the top portion of the lead chuck is unlikely to be compressed inwards. For that reason, the lead can be firmly pinched.

(4) The gap between the lead chuck and the tapered inside circumferential surface of a sleeve is made narrow enough to prevent balls from dropping off, so as to eliminate a cause of trouble and enhance reliability.

(5) Since a frame which restrains the slider at the bottom thereof is slid through the engagement of the frame with the sleeve while following the lead chuck and the sleeve, an ensure engagement means such as slipping friction resistance is not needed but sure operation can be performed.

(6) Since a large number of pipes which would conventionally be needed consist of only an outer pipe, the frame and the sleeve, the diameter, size and weight of the mechanical pencil can be made small.

What is claimed is:

1. A mechanical pencil comprising: an outer pipe having an interior chamber;

a lead chuck mounted in said interior chamber;

a lead pipe slidably disposed within said interior chamber;

a bottom bearer fixedly attached to a forward end of said lead pipe and having at least one radial projection;

a sleeve slidably mounted in said interior chamber surrounding said lead chuck and at least a forward end of said bottom bearer, said sleeve being movable between a first position and a second position located forwardly of said first position;

a bottom pipe disposed in said interior chamber forward of said sleeve;

said sleeve when in its second position having a forward end in abutment with said bottom pipe;

said sleeve including a radial projection engaging means for engaging said at least one radial projection of said bottom bearer;

said bottom bearer being movable between a first position and a second position located forwardly of said first position, said bottom bearer when in it first position retaining said sleeve in its first position;

biasing means for yieldably urging said bottom bearer to its first position;

said bottom bearer and said sleeve cooperating such that as said bottom bearer moves from its first position to its second position, said at least one radial projection engages with said radial projection engaging means until it carries said sleeve to its second position when said at least one radial projection rides over said radial projection engaging means and said bottom bearer moves forward until it reaches its second position, and as said bottom bearer moves from its second position to its first position, said at least one radial projection engages with said radial projection engaging means until it caries said sleeve to its first position, then said at least one radial projection rides back over said radial projection engaging means and said bottom bearer moves to its second position;

wherein said radial projection engaging means is integrally formed with said sleeve;

and wherein said at least one radial projection is disposed and moves longitudinally within at least one longitudinally elongated groove formed in a circumferential wall of said sleeve.

2. A mechanical pencil as recited in claim 1, wherein said radial projection engaging means comprises inwardly projecting friction members defined on inner sides of said at least one longitudinally elongated groove.

3. A mechanical pencil as recited in claim 2, wherein said inwardly projecting friction members are formed on inner sides of said elongated groove as rearwardly and inwardly tapered walls.

4. A mechanical pencil as recited in claim 2, wherein said inwardly projecting friction members comprise jagged surfaces.

5. A mechanical pencil comprising: an outer pipe having an interior chamber;

a lead chuck mounted in said interior chamber;

a lead pipe slidably disposed within said interior chamber;

a bottom bearer fixedly attached to a forward end of said lead pipe and having a radial projection;

a sleeve slidably mounted within said interior chamber surrounding said lead chuck and at least a forward end of said bottom bearer;

said sleeve having a longitudinally elongated groove formed in its circumferential wall;

said bottom bearer being reciprocable within said sleeve and having a close fit therein, and said radial projection extending into and being reciprocable within said elongated groove of said sleeve;

a bottom pipe disposed within said interior chamber forwardly of said sleeve;

and means for causing said bottom bearer to move said sleeve forwardly upon forward movement of said bottom bearer, such that a forward face of said sleeve moves into abutment with said bottom pipe.

6. A mechanical pencil as recited in claim 5, wherein said means for causing said bottom bearer to move said sleeve forwardly comprises at least one inwardly facing projection in said elongated groove forming a narrowed portion of said groove which is narrower than the width of said radial projection, such that once said forward face of said sleeve is in abutment with said bottom pipe, forward force on said bottom bearer above a predetermined amount will cause said radial projection to resiliently widen said narrowed portion to allow further forward movement of said bottom bearer within said sleeve.

7. A mechanical pencil as recited in claim 6, wherein said at least one inwardly facing projection is formed as a rearwardly and inwardly tapered wall.

8. A mechanical pencil as recited in claim 6, wherein said at least one inwardly facing projection comprises a jagged surface.

* * * * *